US008424697B2

(12) United States Patent
Pucci

(10) Patent No.: US 8,424,697 B2
(45) Date of Patent: Apr. 23, 2013

(54) CAPS, CONTAINERS AND METHODS

(75) Inventor: Fabrizio Pucci, Castel Guelfo (IT)

(73) Assignee: Sacmi Cooper MacCanici Imola Societa'Cooperativa, Imola (BO) (IT)

( * ) Notice: Subject to any disclaimer, the term of this patent is extended or adjusted under 35 U.S.C. 154(b) by 962 days.

(21) Appl. No.: 11/919,335

(22) PCT Filed: Apr. 26, 2006

(86) PCT No.: PCT/IB2006/001020

§ 371 (c)(1),
(2), (4) Date: Mar. 4, 2008

(87) PCT Pub. No.: WO2006/114697

PCT Pub. Date: Nov. 2, 2006

(65) Prior Publication Data

US 2009/0314776 A1 Dec. 24, 2009

(30) Foreign Application Priority Data

Apr. 27, 2005 (IT) ..... MO2005A0099

(51) Int. Cl.
*B65D 39/00* (2006.01)

(52) U.S. Cl.
USPC ..... 215/243; 215/251; 215/254; 220/254.3

(58) Field of Classification Search ..... 215/243, 215/200, 224, 251, 254; 220/216, 254.3, 220/259.1, 240, 288, 266
See application file for complete search history.

(56) References Cited

U.S. PATENT DOCUMENTS

| | | | | |
|---|---|---|---|---|
| 3,908,855 | A | 9/1975 | Rowe et al. | |
| 4,126,244 | A * | 11/1978 | Elser | 220/268 |
| 4,394,918 | A * | 7/1983 | Grussen | 215/243 |
| 5,605,240 | A * | 2/1997 | Guglielmini | 215/256 |
| 5,915,601 | A * | 6/1999 | Ullrich et al. | 222/541.6 |
| 5,944,207 | A * | 8/1999 | Reidenbach | 215/243 |
| 6,474,490 | B1 * | 11/2002 | Seibel et al. | 215/232 |
| 7,059,485 | B1 * | 6/2006 | Reidenbach | 215/252 |
| 7,832,580 | B2 * | 11/2010 | Jackman | 215/347 |

(Continued)

FOREIGN PATENT DOCUMENTS

| | | |
|---|---|---|
| DE | 200 03 011 | 8/2000 |
| EP | 0 147 507 | 7/1985 |

(Continued)

OTHER PUBLICATIONS

International Search Report dated Dec. 7, 2006.

(Continued)

*Primary Examiner* — Mickey Yu
*Assistant Examiner* — Kareen Rush
(74) *Attorney, Agent, or Firm* — Nixon & Vanderhye P.C.

(57) ABSTRACT

A pressure cap comprises a closing part associable with an opening of a container, engaging means associable with a neck of said container, said engaging means being provided with retaining means for engaging in a projection of said container, a line of intended opening in said engaging means interposed between a side body of said engaging means and said closing part, said line of intended opening being defined by fracturable means, said line of intended opening and said closing part being positioned in relation to one another so that said fracturable means breaks along said line of intended opening when said closing part is induced to detach itself from said side body.

22 Claims, 25 Drawing Sheets

U.S. PATENT DOCUMENTS

| | | | | |
|---|---|---|---|---|
| 2001/0002661 | A1 | 6/2001 | Reidenbach | |
| 2003/0051440 | A1* | 3/2003 | Chow et al. | 53/412 |
| 2006/0249474 | A1* | 11/2006 | Sawyer et al. | 215/256 |

FOREIGN PATENT DOCUMENTS

| | | |
|---|---|---|
| FR | 2 215 361 | 8/1974 |
| GB | 2 164 028 | 3/1986 |
| JP | H03-648 | 1/1991 |
| JP | H05-47086 | 12/1993 |
| JP | 2005-529031 | 9/2005 |
| JP | 3764994 | 4/2006 |

OTHER PUBLICATIONS

International Preliminary Report on Patentability dated Aug. 10, 2007.

Second Office Action issued in Chinese Appln. No. 200680020068.X (Jan. 21, 2012).

Office action in related EP Application No. 10 180 371 dated May 25, 2011.

English Translation of Japanese Office Action Application No. 2008-508328 dated Sep. 20, 2012.

* cited by examiner

CAPS, CONTAINERS AND METHODS

This application is a U.S. national phase of International Application No. PCT/IB2006/001020 filed 26 Apr. 2006, which designated the U.S. and claims priority to IT MO2005A000099 filed 27 Apr. 2005, the entire contents of each of which are hereby incorporated by reference.

The invention relates to caps, containers and methods for manufacturing and opening caps. Pressure caps (200) are known that are made of plastic, shown in FIGS. 1 and 2, that are associable with a container (204). These caps comprise a closing part (201) provided with a retaining element (202) that engages a neck (203) of the container. The known caps are furthermore provided with a tamperproof ring (205) that, before opening, surrounds the neck.

The tamperproof ring is connected to the closing part of the cap by means of fracturable elements. The tamperproof ring is furthermore provided with hooking elements that prevent the closing part from being removed from the tamperproof ring, and thus the opening of the container, without breaking of the fracturable elements occurring.

From the tamperproof ring an appendage (206) projects arranged for being grasped by a user. By exerting a force on the appendage it is possible to break the fracturable elements and possibly separate the tamperproof ring from the body of the cap.

Subsequently, the user, by acting on the closing part, can remove the retaining element from the neck and thus open the container.

A drawback of known pressure caps consists of the fact that they are removable from the respective containers with a certain difficulty.

In a first phase the user in fact has to break the fracturable elements by acting on the appendage of the tamperproof ring and subsequently removing the closing part from the neck.

To open the containers the user necessarily has to use both hands, one hand is in fact used to grasp the container whereas the other hand is used to act on the appendage in order to break the fracturable elements.

Known caps cannot therefore be used for applications for which the possibility of opening the containers using only one hand is required, such as, for example, in the case of containers the contents of which have to be consumed during the course of a sporting activity, such as a bicycle ride or the like.

Screw caps (300) are furthermore known, shown in FIGS. 3 and 4, provided with a body (301) screwable on a threaded end of a container and of a closing part (302) connected to the body by means of a hinge element (303). A drawback of the caps disclosed above is that they are very complicated and expensive to make.

These caps are in fact obtained through injection moulding of plastic material inside very complicated moulds.

An object of the invention is to improve known pressure caps.

Another object of the invention is to obtain pressure caps that can be opened easily.

A further object of the invention is to obtain pressure caps that are easily reclosable after a first opening.

A still further object of the invention is to obtain caps provided with a hinge interposed between a closing part and a fixing part fixing to a container that can be manufactured without the use of complex moulds.

A still further object of the invention is to obtain pressure caps that can be associated with usual threaded necks of containers.

A still further object is to obtain containers that are particularly suitable for being shut with pressure caps.

In a first aspect of the invention, a pressure cap is provided, comprising a closing part associable with an opening of a container, an engaging arrangement associable with a neck of said container, said engaging arrangement being provided with a retaining arrangement for engaging a projection of said container, a line of intended opening in said engaging arrangement interposed between a side body of said engaging arrangement and said closing part, said line of intended opening being defined by a fracturable arrangement, wherein said line of intended opening and said closing part are positioned in relation to one another so that said fracturable arrangement breaks along said line of intended opening when said closing part is induced to detach itself from said side body.

Owing to this aspect of the invention, it is possible to obtain a pressure cap that is provided with an opening indicating arrangement and that can be easily opened by a user, possibly with just one hand.

This enables a significant improvement to be obtained with respect to the state of the art which provides only two types of pressure caps. A first type consisting of easily openable caps, but devoid of opening indicating arrangement, and a second type consisting of caps provided with opening indicating arrangement but which are complicated to open.

Owing to the invention, when the first opening of the container occurs the fracturable arrangement is substantially fractured simultaneously to the removal of the closing part.

It is not therefore necessary to perform two distinct operations, a first breaking operation of the fracturable elements and a second removing operation of the closing part.

In a second aspect of the invention, a screw cap is provided, comprising a side body screwable on a neck of a container and a closing part associable with an opening of said container, wherein it further comprises a line of intended opening arranged substantially at the interface between said side body and said closing part.

Owing to this aspect of the invention, it is possible to obtain a screw cap that can be opened without removing the side body from the neck, unscrewing it from the latter.

In particular, the closing part can define a pressure closing element associated with an opening of the container.

In this way, it is possible to obtain easily openable caps, for example pressure caps, that can be associated with usual threaded necks and can be manufactured using usual moulds for forming plastic material, such caps being provided with an opening indicating arrangement that indicate to a user whether the container has been tampered with prior to the first use.

In a third aspect of the invention, a method is provided for opening a screw cap, said cap comprising a side body screwable on a neck of a container, a closing part associable with an opening of said container and a line of intended opening defined by a fracturable arrangement and arranged substantially at the interface between said side body and said closing part, comprising screwing said side body onto said neck so that an edge of said neck interacts with said closing part to break said fracturable arrangement along said line of intended opening.

Owing to this aspect of the invention, it is possible to obtain a very simple method for opening a screw cap.

In a fourth aspect of the invention, a screw cap is provided, comprising a side body screwable on a neck of a container and a closing part associable with an opening of said container, wherein it further comprises an unscrewing promoting arrangement arranged for partially unscrewing said side body from said neck after a first opening of said cap.

Owing to this aspect of the invention, it is possible to obtain a cap that can easily be opened by screwing the side body onto the neck, so that an edge of the neck interacts with the closing part to break the fracturable arrangement along the line of intended opening. Subsequently to the opening, the unscrewing promoting arrangement partially unscrews the side body from the neck so as to position the side body suitably with respect to the neck.

In this case, if between the side body and the closing part a hinge is provided the unscrewing promoting arrangement positions the side body so that the closing part, by rotating around the hinge, can engage the neck correctly for enabling the container to be closed again after a first opening.

In a fifth aspect of the invention, a cap is provided, comprising a side body associable with a neck of a container, a closing part associable with an opening of said container and a line of intended opening interposed between said side body and said closing part, wherein it further comprises a wall thickening on said line of intended opening so as form a hinge that connect said side body and said closing part.

Owing to this aspect of the invention, it is possible to obtain a cap provided with a hinge made extremely simply.

In particular, it is possible to obtain a cap provided with a hinge by means of moulding of plastic material, without very complex moulds having to be used.

During the first opening of the cap, the portion of the line of intended opening that is not affected by the wall thickening fractures, whereas the wall thickening, owing to the greater section, is not fractured and defines the hinge around which the closing part can rotate in relation to the side body to enable the dispensing of a product contained in the container.

In a sixth aspect of the invention, a container is provided, comprising a neck provided with a dispensing end having a transverse dimension that is greater than the transverse dimension of a remaining part of neck, wherein the dispensing end comprises a wall having a substantially uniform thickness.

In a seventh aspect of the invention, a container is provided comprising a neck provided with a dispensing end defined by a wall, wherein it further comprises a projection arrangement extending from an intermediate portion of said wall.

Owing to these aspects of the invention it is possible to obtain containers that are particular suitable for being closed by pressure caps.

In an eighth aspect of the invention, a container is provided comprising a neck provided with a dispensing end having a transverse dimension that is greater than the transverse dimension of a remaining part of neck, said dispensing end defining in said container a projection in which a retaining arrangement of a cap is engageable, wherein it further comprises a further projection that cooperates with said projection to define a seat arrangement in which said retaining arrangement is receivable.

In a ninth aspect of the invention, a combination of a cap comprising a retaining arrangement with a container comprising a neck provided with a dispensing end having a transverse dimension that is greater than the transverse dimension of a remaining part of neck is provided, said dispensing end defining in said container a projection in which said retaining arrangement is engageable, and a further projection that cooperates with said projection to define a seat arrangement in which said retaining arrangement is receivable.

Owing to these aspects of the invention, it is possible to obtain a container that it is difficult to tamper with inasmuch as the retaining arrangement is received inside the seat arrangement.

Furthermore, if a cap provided with a hinge is associated with the container, the further projection acts as a positioning element for preventing a move of the retaining arrangement with respect to the container, so that the container can be easily closed after a first opening. A move of a side body of the container that is integral with the retaining arrangement with respect to the neck could in fact prevent a closing part from engaging correctly with the neck.

In a tenth aspect of the invention, a container is provided comprising a neck provided with an opening and with a projection projecting from said neck, said neck comprising a wall extending between said projection and said opening, wherein said wall comprises a substantially smooth external surface.

In an eleventh aspect of the invention, a method is provided for producing a cap provided with a hinge, comprising forming a side body of said cap, weakening said side body for obtaining a line of intended opening, wherein said weakening comprises obtaining in said side body, along said line of intended opening, a less weakened zone of a remaining part of said side body, said less weakened zone defining a hinge precursor.

Owing to this aspect of the invention, it is possible to obtain a method for producing a cap provided with a hinge that it is very simple to actuate inasmuch as it does not require the use of complicated moulds.

Furthermore, in the case of caps formed by injection or compression moulding of plastic material, the method is very cheap inasmuch as the hinge precursor is obtained by the same weakening operation with which the line of intended opening is obtained.

The method according to the invention does not therefore involve any additional complication with respect to the usual method of manufacture of the caps.

In a twelfth aspect of the invention, a cap is provided, comprising a side body associable with a neck of a container, a closing part associable with an opening of said container and a line of intended opening defined by a fracturable arrangement and interposed between said side body and said closing part, wherein said fracturable arrangement has non-uniform breaking resistance.

Owing to this aspect of the invention, it is possible to obtain a cap the opening of which can be initiated by applying very modest force to the closing part. This enables a user to open the cap easily, possibly using just one hand.

The invention can be better understood and implemented with reference to the attached drawings that illustrate some embodiments thereof by way of non-limitative examples, in which.

Figure 1:
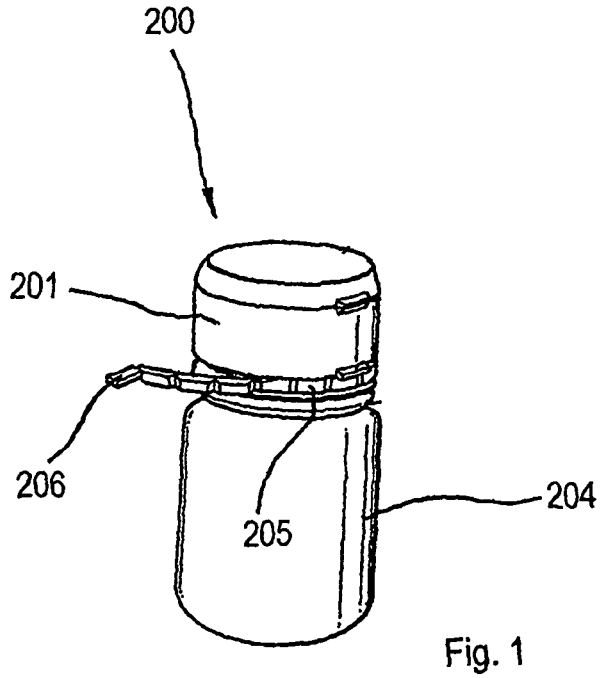
Fig. 1 PRIOR ART
FIG. 1 is a perspective lateral view of a pressure cap according to the prior art, shown in a closed configuration.
Figure 2:
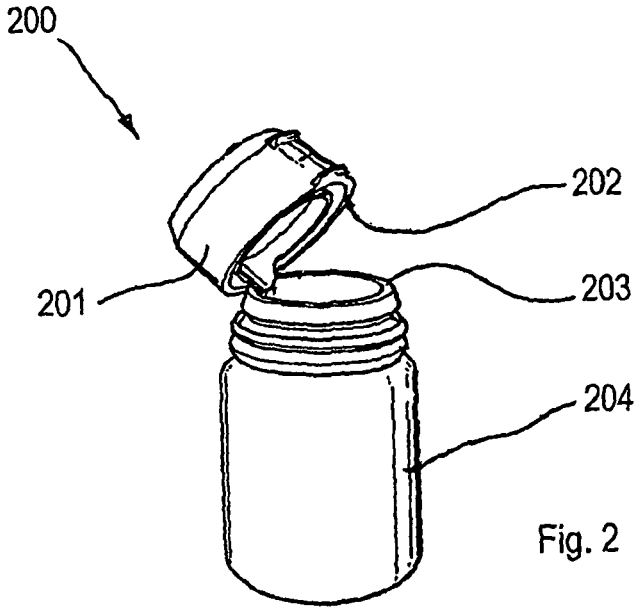
Fig. 2 PRIOR ART
FIG. 2 is a view like the one in FIG. 1, showing the cap in an open configuration.
Figure 3:
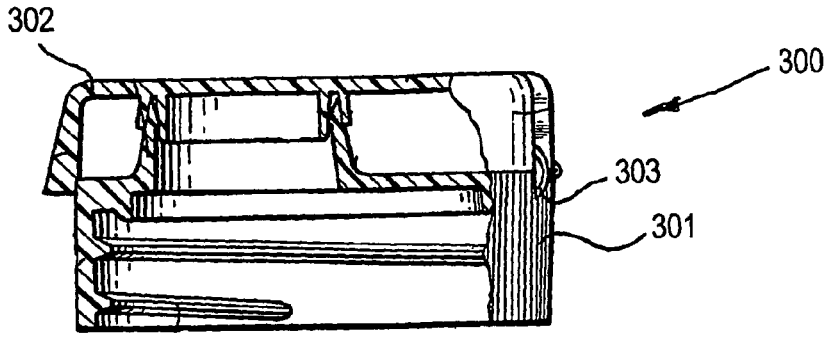
Fig. 3 PRIOR ART
FIG. 3 is a partially sectioned side view of a screw cap according to the prior art, shown in a closed configuration.
Figure 4:
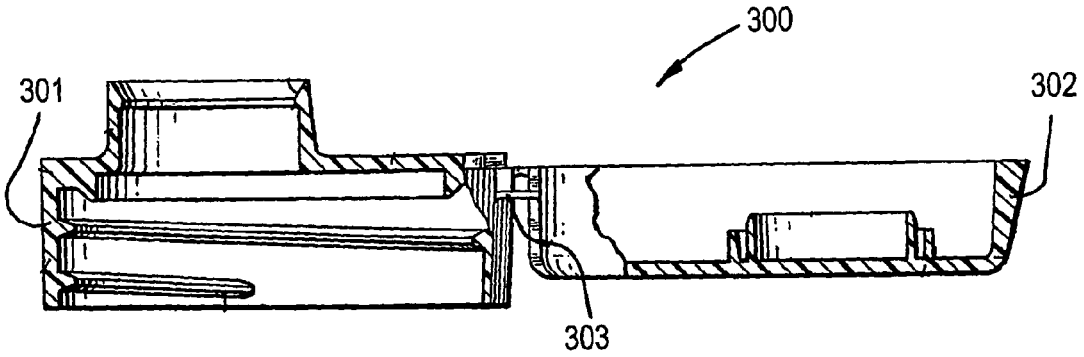
Fig. 4 PRIOR ART
FIG. 4 is a view like the one in FIG. 3, showing the cap in an open configuration.
Figure 5:
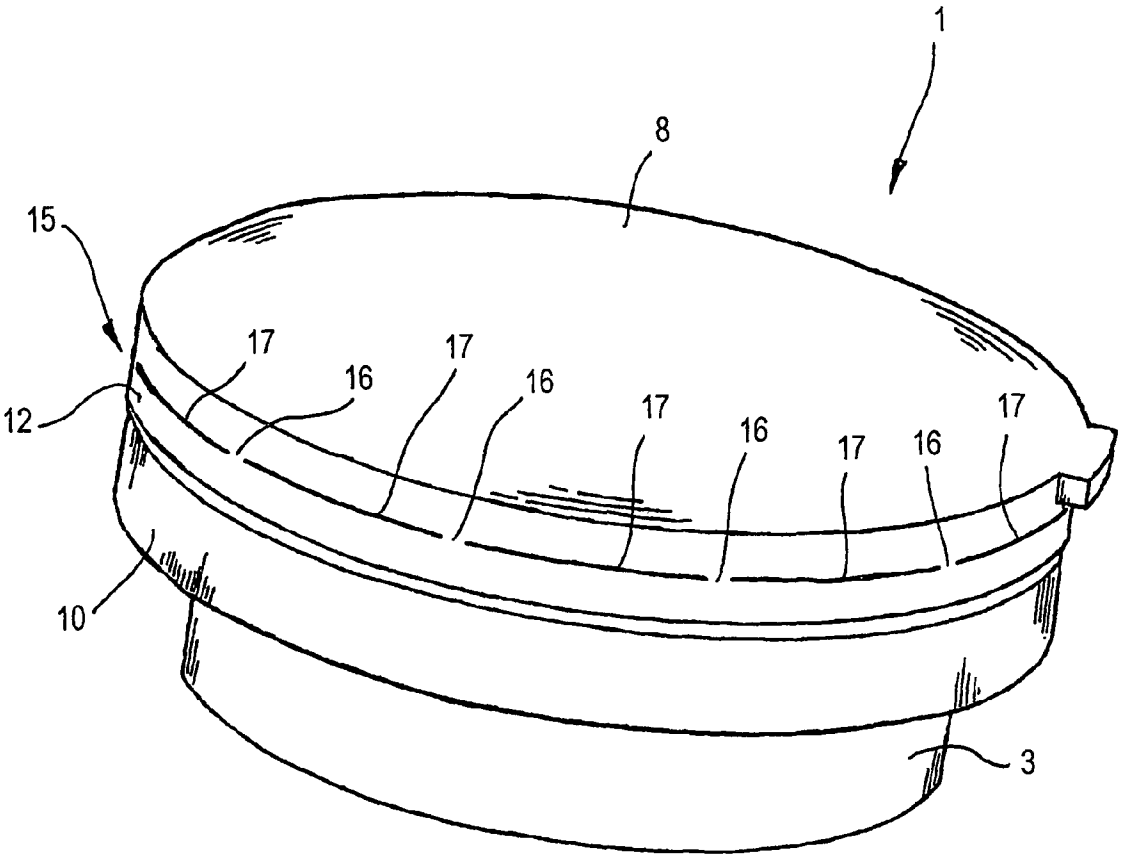
FIG. 5 is a perspective view of a pressure cap associated with a container neck.
Figure 6:
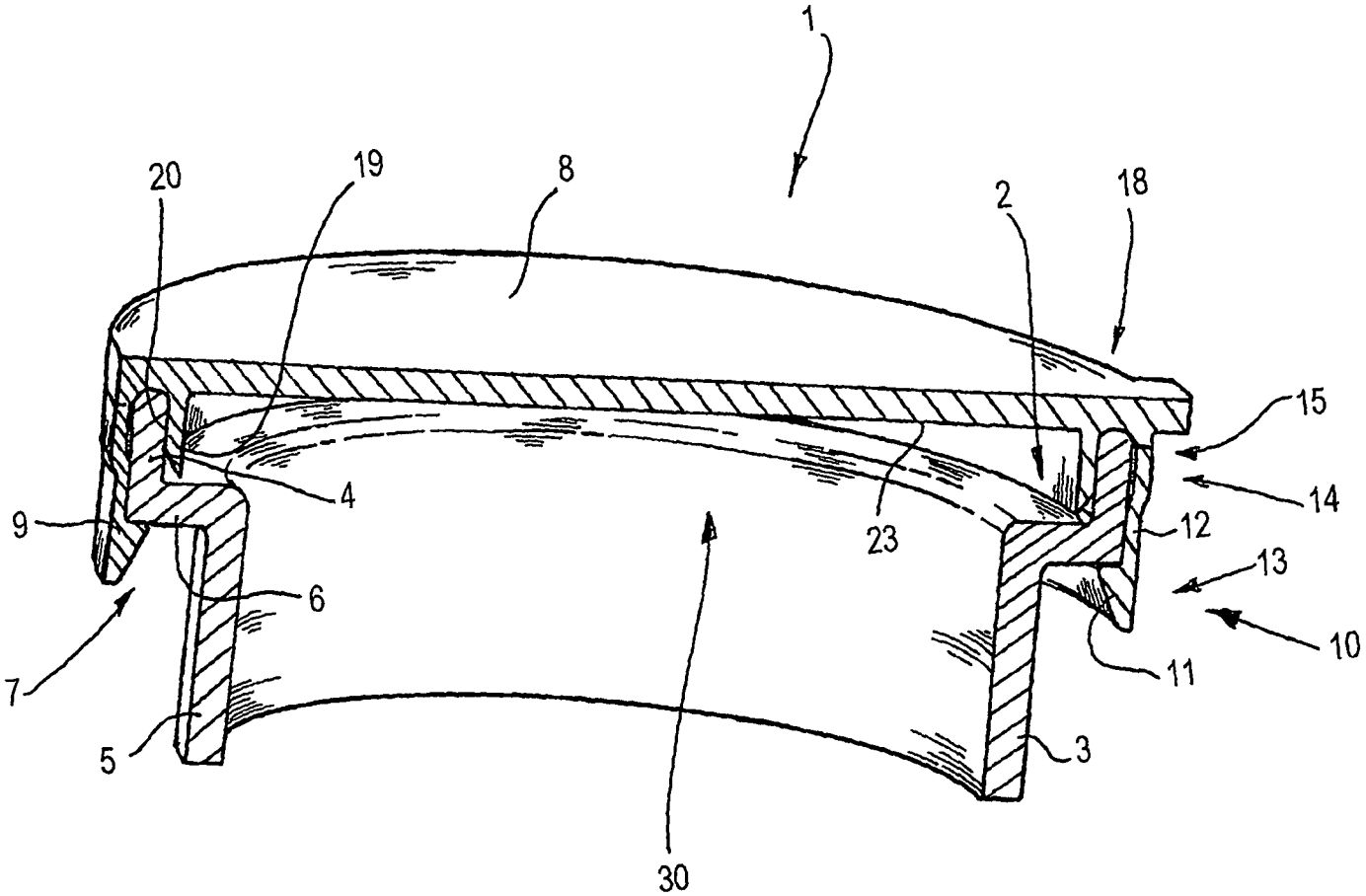
FIG. 6 is a perspective view of the cap in FIG. 5 sectioned along a longitudinal plane.

With reference to FIGS. 5 and 6 a cap 1 is shown that is associable with a neck 2 of a container 3.

The cap 1 can be made of plastic material, for example through injection or compression moulding of plastics.

The container 3 comprises a substantially cylindrical first wall 4 and a substantially cylindrical second wall 5 arranged substantially coaxially, the second wall 5 having a diameter less than that of the first wall 4.

The first wall 4 has a substantially constant thickness and defines a dispensing end of the container 3. Between the first wall 4 and the second wall 5 an annular wall 6 extends transversely to the latter that defines a collar 7.

Figure 11:
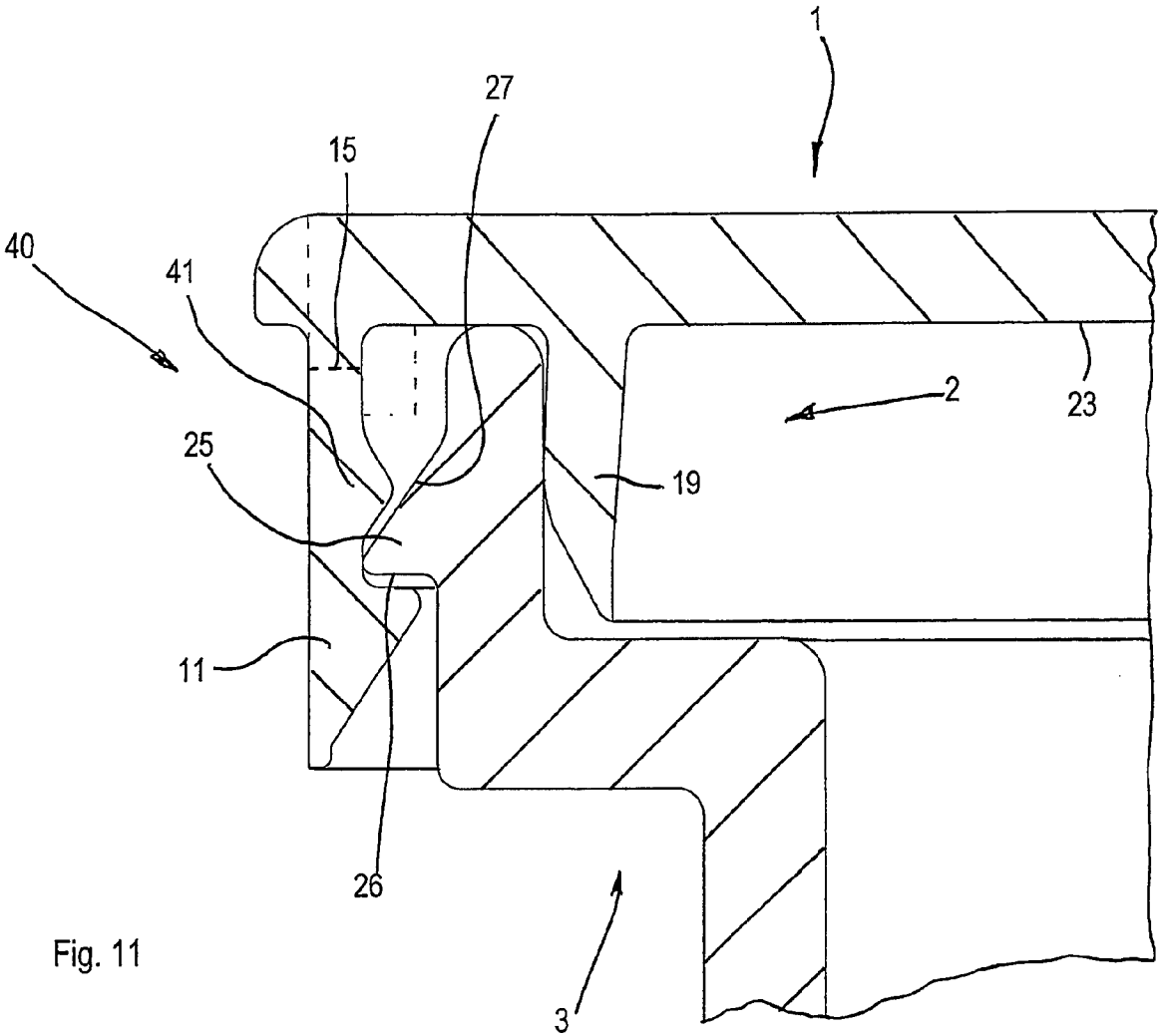
FIG. 11 is a section like the one in FIG. 7 showing a cap made according to a still further variation and associated with another container neck.

With reference to FIG. 11, a variation of the container 3 is shown in which from the first wall 4 a projection 25 extends that is arranged for interacting with the cap 1, as will be disclosed in greater detail below.

The projection 25 comprises a further annular wall 26 extending substantially perpendicular with respect to the first wall 4 and a tilted wall 27 interposed between the further annular wall 26 and the first wall 4.

Figure 14:
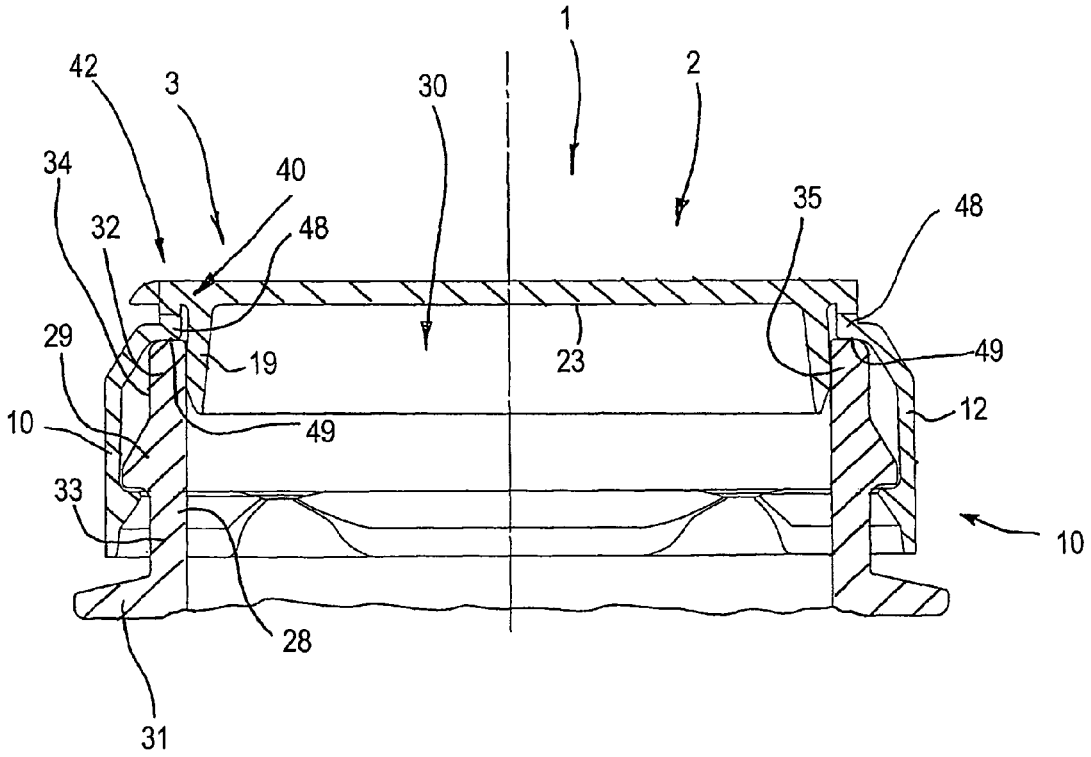
FIG. 14 is a section like the one in FIG. 7 showing a cap made according to a further variation and associated with a further container neck.

With reference to FIG. 14, another variation of the container 3 is shown comprising a side wall 28 from which a projection element 29 projects, nearer an opening 30 of the container 3, and a second projection element 31, further away from the opening 30.

The side wall 28 comprises a first substantially cylindrical portion 32, interposed between the first projection element 29 and the opening 30, and a second substantially cylindrical portion 33, interposed between the first projection 29 and the second projection element 31.

The first portion 32 comprises a substantially smooth external surface 34.

The first portion 32 and the second portion 33 can have a substantially constant thickness.

In addition, the first portion 32 and the second portion 33 are shaped so that the container 3 is provided with a dispensing end 35 having a substantially constant inner diameter.

As shown in FIGS. 5 and 6, the cap 1 comprises a closing part 8 removably associable with the opening 30 and an engaging arrangement 10 provided with a retaining arrangement 11, provided with a hook-shaped end, that engages the collar 7.

The engaging arrangement 10 comprises a side body 12 having a first end 13 from which the retaining arrangement 11 projects and a second end 14, opposite the first end 13, at which a line of intended opening 15 is provided extending between the side body 12 and the closing part 8.

The line of intended opening 15 is defined by a plurality of fracturable elements 16 that connect the closing part 8 to the side body 12, between adjacent fracturable elements 16 there being interposed a weakened zone, for example a through cut 17.

When the closing part is moved away from the side body 12, the fracturable elements 16 are fractured, making the opening of the cap 1 clear.

In other words, the engaging arrangement 10, owing to the retaining arrangement 11 that prevents the cap 1 from being able to be removed from the container without breakage of the fracturable elements 16 occurring, acts like an antitamper ring that assures the integrity of the cap 1.

The closing part 8 comprises a closing arrangement 18 provided with an annular appendage 19 that projects from a face 23 of the closing part 8 to be received inside the first wall 4.

The annular appendage 19 is shaped so as to interact with interference with an internal surface 20 of the first wall 4.

The closing arrangement 18 enables a seal to be achieved between the closing part 8 and the neck 2.

Figure 8:
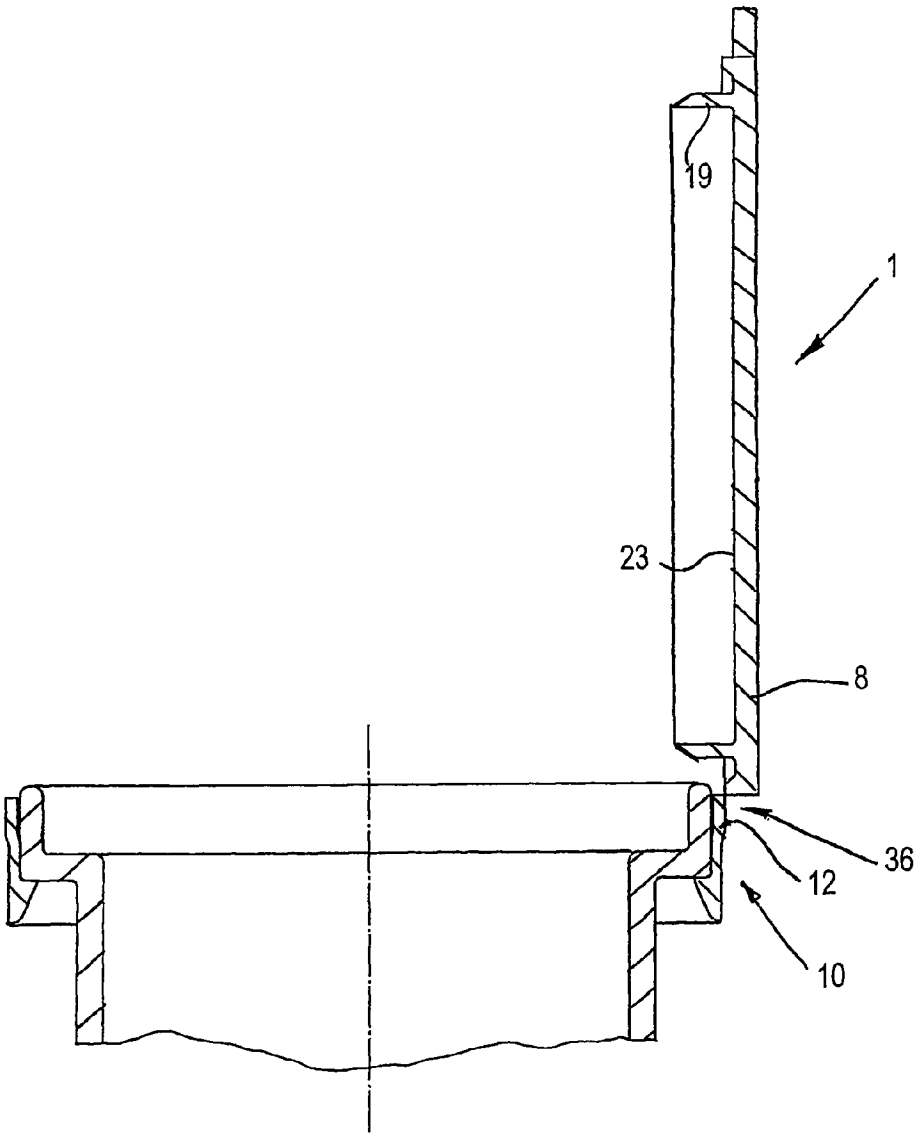
FIG. 8 is a section like the one in FIG. 7 showing the cap in an open configuration.

A closing arrangement comprising the annular appendage 19 is also provided in the embodiments of the cap 1 shown in the FIGS. 8 and from 10 to 14.

Figure 7:
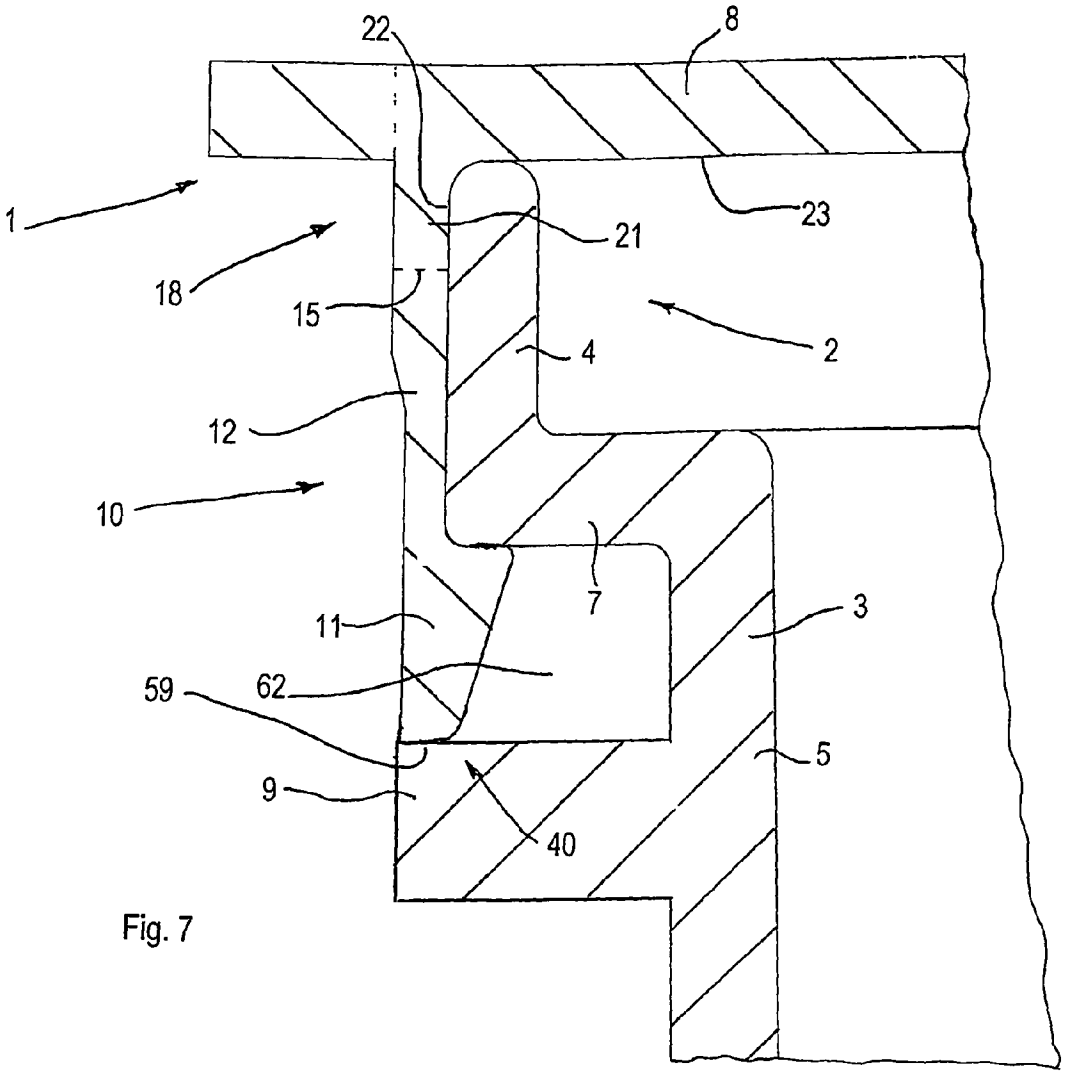
FIG. 7 is a schematic and fragmentary section, taken along a longitudinal plane, of a cap like the one in FIG. 5 made according to a variation.

The embodiment of the cap 1 shown in FIG. 7 is provided with a closing part 8 provided with a closing arrangement 18 comprising a further annular appendage 21 that projects from the face 23 for surrounding the first wall 4.

The further annular appendage 21 is shaped so as interact with interference with a substantially smooth external surface 22 of the first wall 4.

Figure 9:
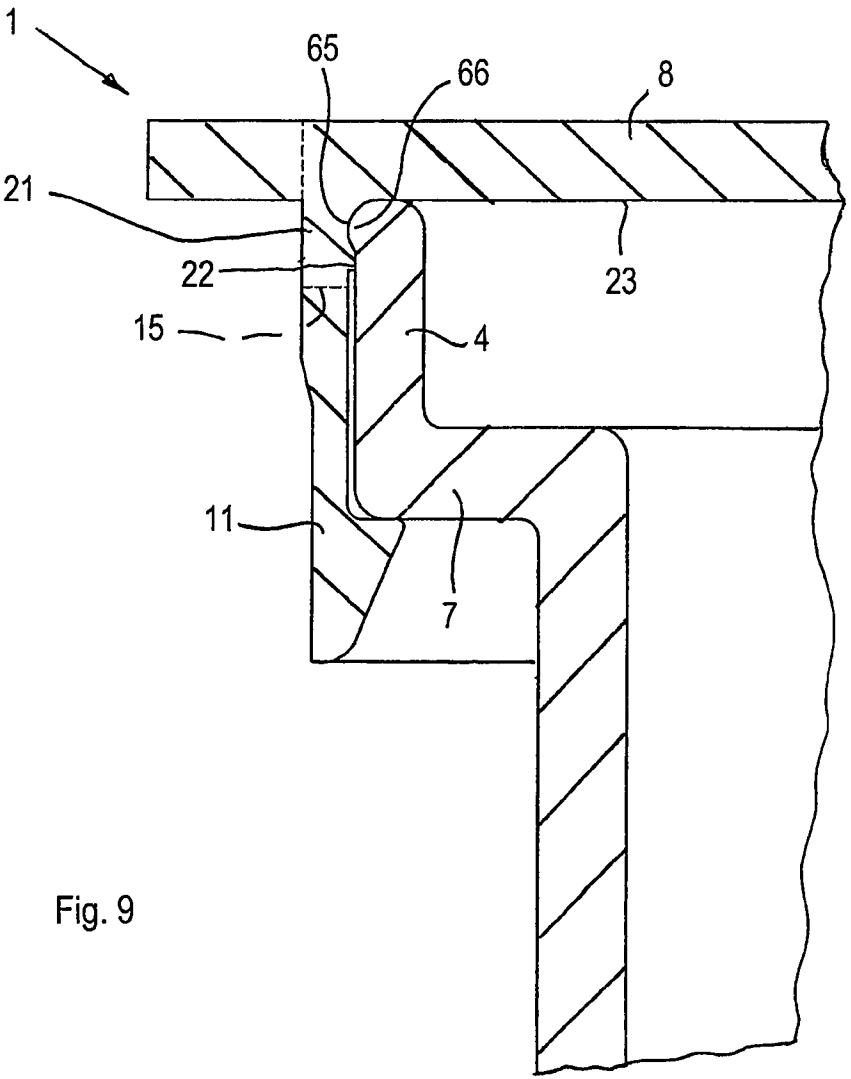
FIG. 9 is a section like the one in FIG. 7 showing a cap made according to another variation.

With reference to FIG. 9, the further annular appendage 21 comprises a groove 65 arranged for receiving in a shapingly formed manner a fashioned edge 66 extending from the external surface 22.

The closing arrangement 18 may comprise, instead of the annular appendage 19, or of the further annular appendage 21, substantially annular and circumferentially fragmentary bodies, defined, for example, by a plurality of protruding elements extending from the face 23.

As shown in FIG. 8, the cap 1 may comprise a hinge 36 that connects the closing part 8 to the engaging arrangement 10, so as to enable the cap 1 to be closed again after a first opening.

The hinge 36 may comprise a portion of the plastic material with which the cap 1 is made.

The hinge 36 can be obtained in different ways, which will be illustrated below.

Some steps of a production cycle for producing caps through injection or compression moulding should be recalled preliminarily, i.e. in order to enable the manner of making the hinge to be better understood.

The caps are obtained through injection or compression moulding of plastics.

At the outlet of the mould each cap comprises a continuous side wall, i.e. devoid of a line of intended opening. In other words, the cap comprises a closing part that is connected to a respective engaging arrangement without a line of intended opening being defined between the closing part and a side body.

The line of intended opening can be obtained in the course of a subsequent step of the production cycle by making weakening between the closing part and the side body.

This weakening can be obtained by making, using a suitable tool, a fragmentary cut—possibly a through cut—through the side wall of the cap. In this way fracturable elements are obtained having a thickness, radially measured, that is substantially the same as the initial thickness of the side wall.

Alternatively, the weakening can be obtained by crushing the side wall so as to reduce the section thereof to promote breakage during first opening of the cap.

Still alternatively, the cap may comprise ribs distributed circumferentially on the side wall.

In this case, the weakening can be obtained by making a cut that traverses, possibly completely, the entire thickness of the side wall but which does not substantially cut the ribs.

As a result, the ribs form fracturable elements arranged for being fractured during first opening of the cap.

Figure 15:
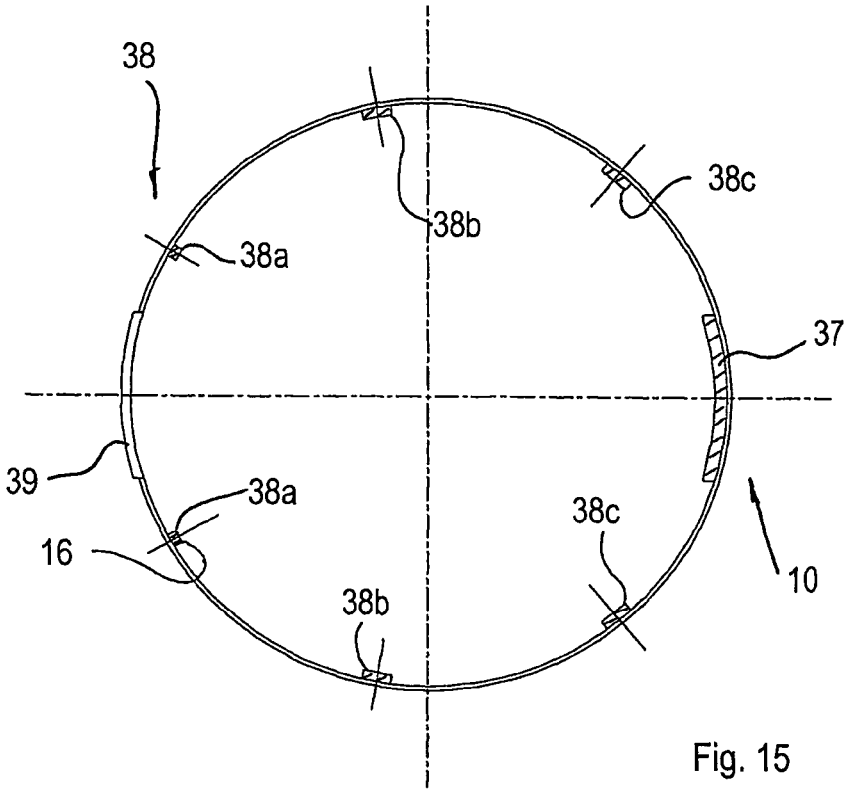
FIG. 15 is a transverse section of a cap showing a line of intended opening defined by fracturable opening indicating elements obtained by means of portions that have variable circumferal extents.

As shown in FIG. 15, the engaging arrangement 10 may comprise a wall thickening 37 that forms the hinge 36 and a plurality of ribs 38 arranged for forming the fracturable elements 16.

The ribs 38 project inside the cap 1.

In an embodiment that is not shown, the ribs can project outside the cap 1.

During the manufacture of the cap 1, the engaging arrangement 10 is made to interact with a tool that makes a cut that cuts the entire circumferal extent of the engaging arrangement 10.

The cut weakens the engaging arrangement 10, for example by completely traversing the latter or extending for a substantial part of the thickness thereof, but does not completely traverse the wall thickening 37, or the ribs 38.

During a first opening of the cap 1, the fracturable elements 16 are fractured whereas the thickening 37 that is provided with a greater section, and therefore with greater resistance to breakage, does not break but is deformed, giving rise to the hinge 16.

Owing to the invention, it is possible to make caps provided with hinges with extreme simplicity, inasmuch as it is not necessary to use the complicated moulds provided in the prior art.

The moulds can in fact easily be designed with a geometry that is such as to enable the wall thickening 37 to be obtained in the caps.

The caps provided with hinges are thus obtained without increased costs or complications to the productive cycle, inasmuch as the wall thickening is obtained directly in the moulding step.

The closing part 8 comprises an opening promoting arrangement 39 arranged at a zone of the closing part 8 substantially opposite the thickening 37.

The ribs 38 have a growing circumferal extent proceeding from the opening promoting arrangement 39 to the thickening 37.

In this way fracturable elements 16 are obtained having a section and therefore a resistance to fracturing that is variable.

In particular, first ribs 38*a*, second ribs 38*b* and third ribs 38*c* are provided having gradually increasing circumferal extents.

During the first opening of the cap 1, the first ribs 38*a*, which are those having a lesser circumferal extent, can be easily fractured by a user who acts on the opening promoting arrangement 39.

Subsequently, once the cap 1 has been partially opened, through the effect of greater leverage/torque, the user can fracture the second ribs 38*b* and the third ribs 38*c* easily, although the second ribs 38*b* and the third ribs 38*c* have greater resistance to breakage than the first ribs 38*a*.

In this way, a cap is obtained the fracturable elements of which have significant resistance, when the cap is applied to a container, to ensure a hermetic seal, even if inside the container the pressure differs with respect to the pressure outside the latter, as occurs in the case of containers filled with gassy drinks.

At the same time, the fracturable elements can easily be broken to ensure good inviolability and to facilitate opening by the consumer.

Figure 16:
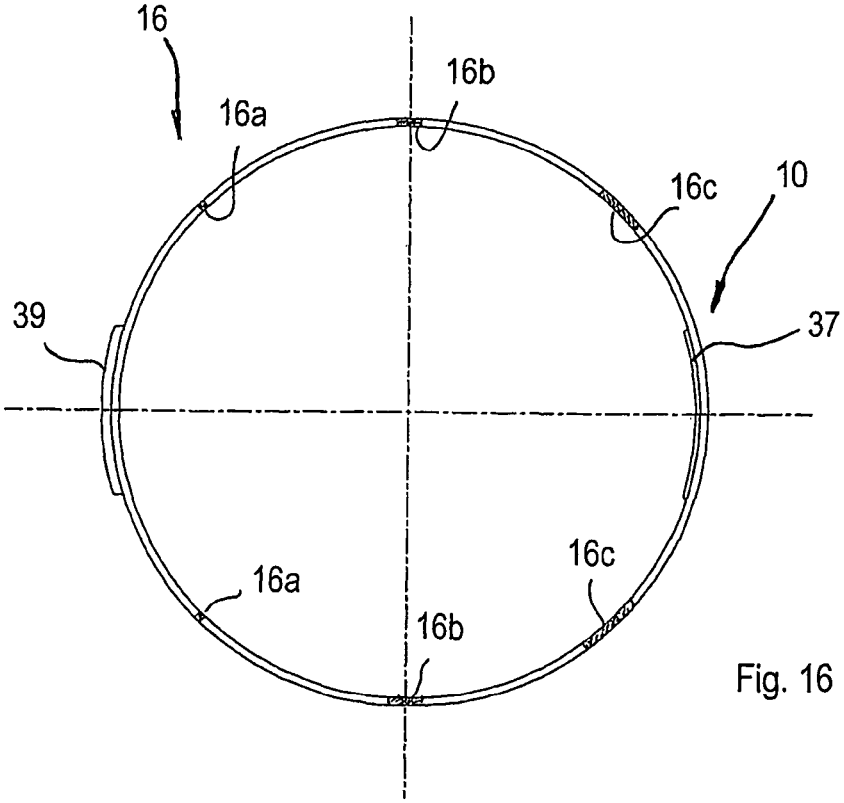
FIG. 16 is a section like the one in FIG. 15 showing fracturable opening indicating elements obtained by means of wall portions of the cap that have variable circumferal extents.

With reference to FIG. 16, a cap is shown provided with the wall thickening 37 and with fracturable elements 16*a*, 16*b* and 16*c* having variable circumferal extents.

In this case, the fracturable elements 16 are obtained by cutting, for example with a through cut, the engaging arrangement 10 using a suitably fashioned tool, in particular a tool provided with a fragmentary blade, or anyway provided with a discontinuity, at least at the fracturable elements 16, and possibly also the thickening 37.

Figure 17:
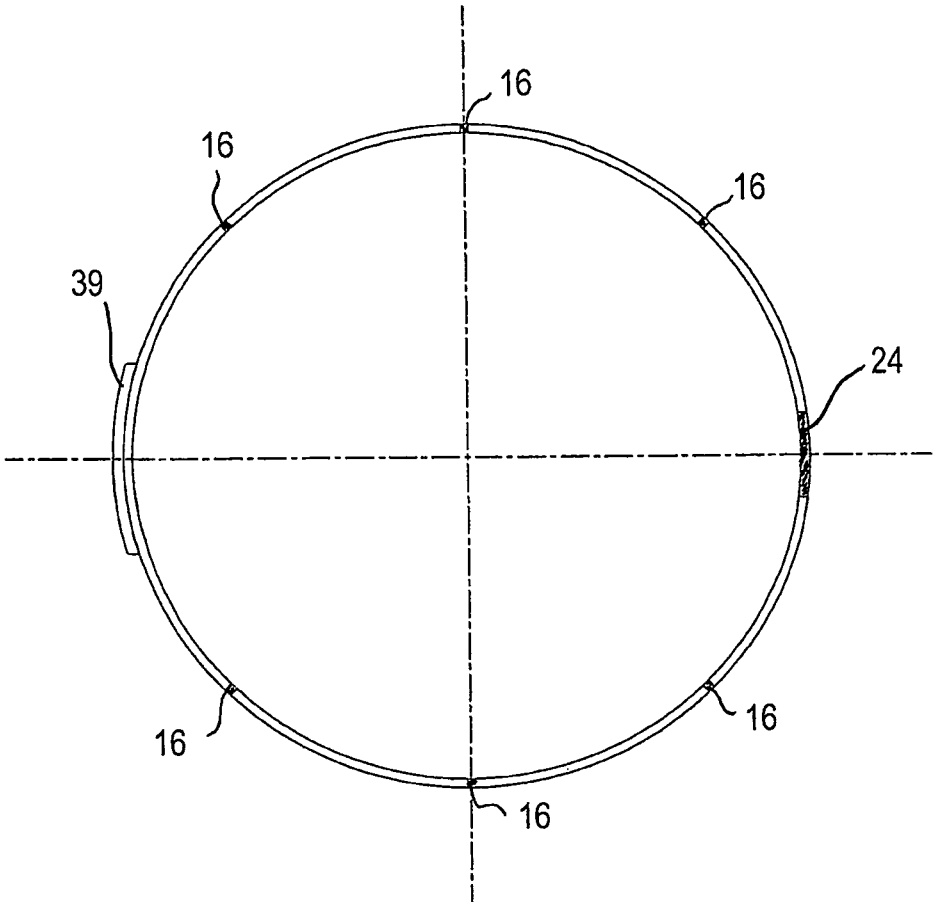
FIG. 17 is a section like the one in FIG. 15 showing fracturable opening indicating elements obtained by means of wall portions of the cap that have constant circumferal extents.

With reference to FIG. 17, a cap is shown that is not provided with the wall thickening 37.

In this case, a hinge precursor 24 and the fracturable elements 16 are obtained by making a cut, possibly a through cut, through the engaging arrangement 10, this cut not affecting zones of the engaging arrangement 11 in which the fracturable elements 16 and the hinge precursor 24 have to be defined.

Also in this case the use of a suitably fashioned cutting tool is provided for.

Figure 18:
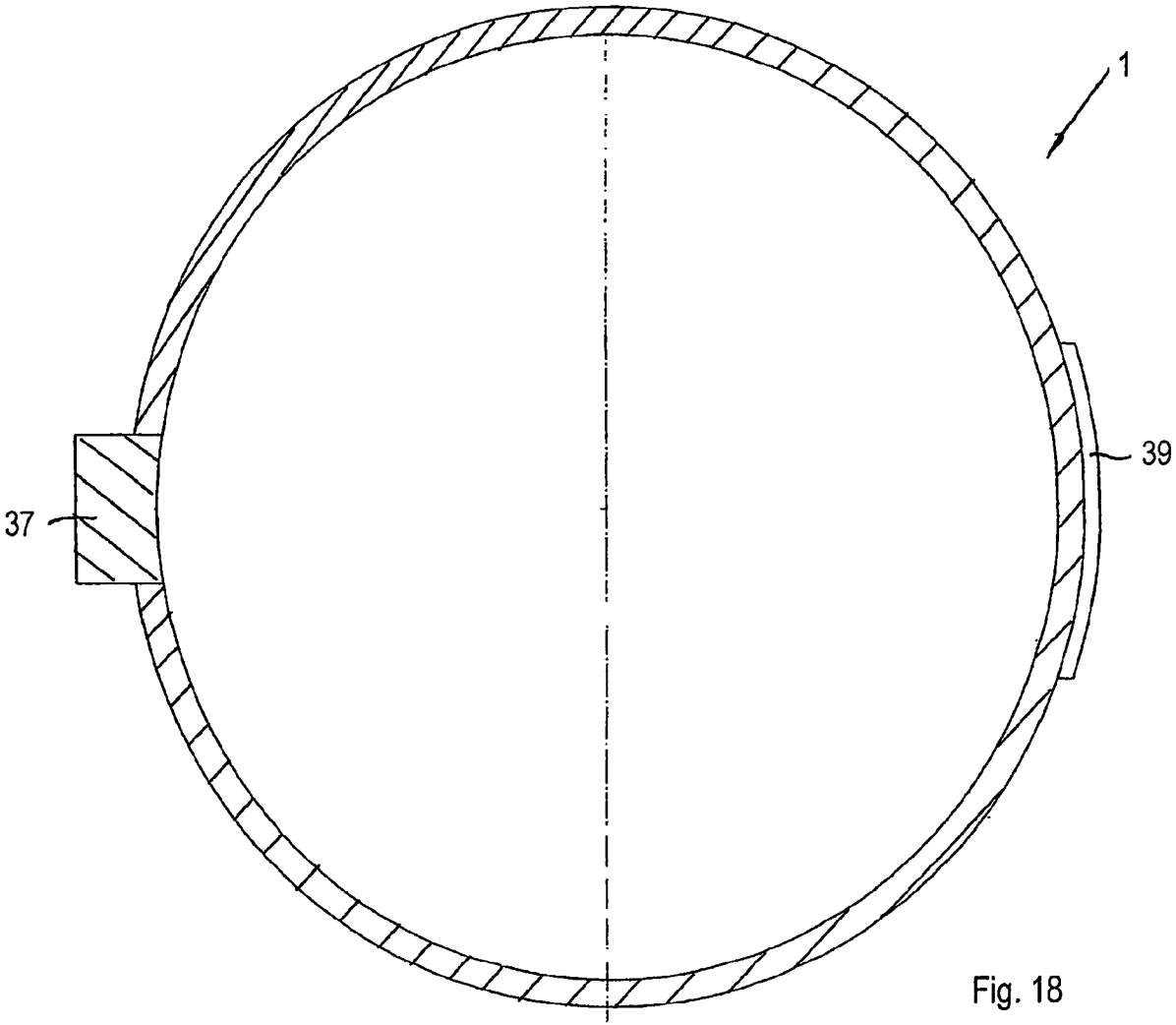
FIG. 18 is a transverse section of a cap provided with a hinge.

With reference to FIG. 18, a cap 1 is shown provided with a thickening 37 that projects outside the engaging arrangement 10.

In this case, the fracturable elements 36 are obtained by using a tool shaped so as not to interact with the thickening 37.

Figure 19:
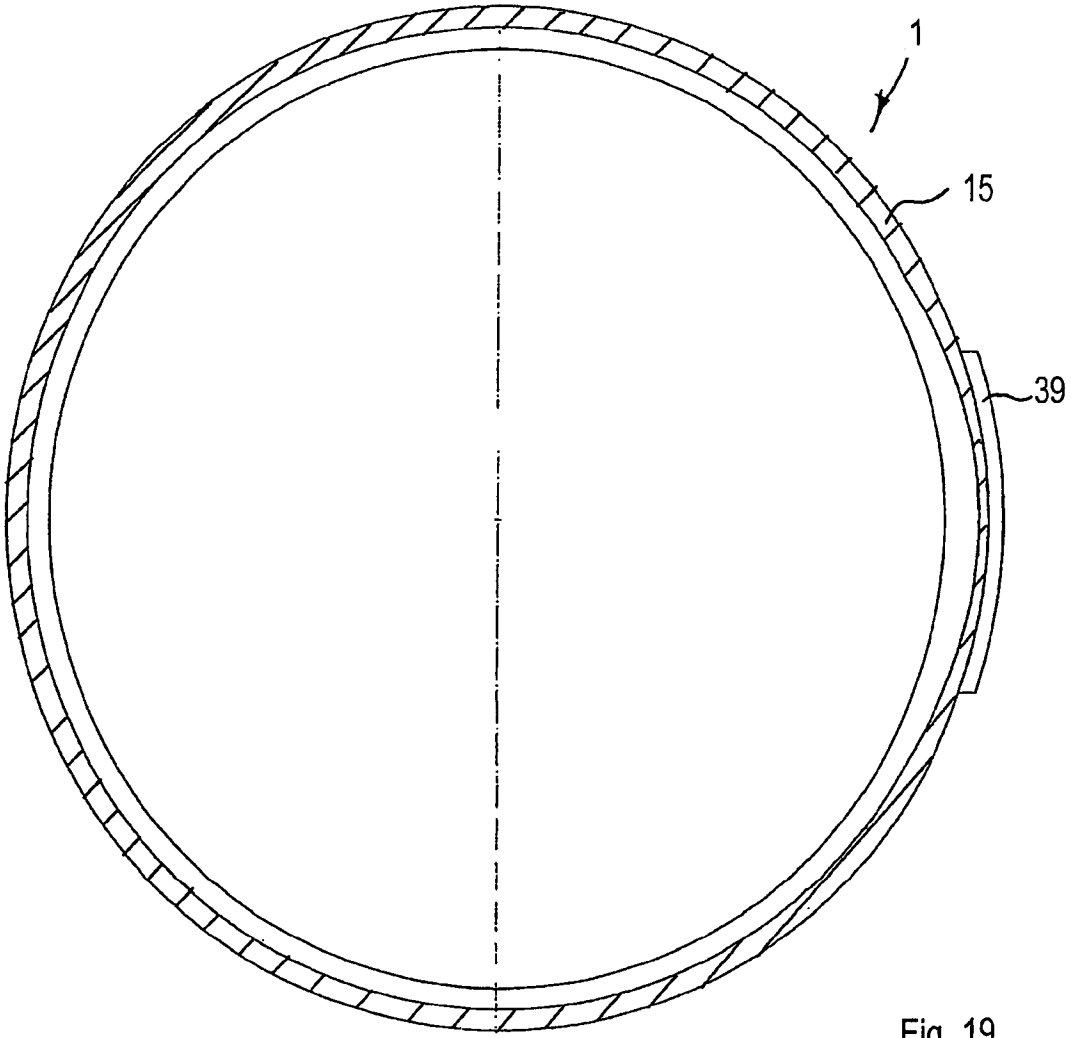
FIG. 19 is a section like the one in FIG. 18 showing fracturable opening indicating elements defined by a wall having a non-uniform thickness.

With reference to FIG. 19, a cap 1 is shown provided with a line of intended opening 15 made by crushing the engaging arrangement 10 so as to cause a decrease in the section thereof to promote breakage at the line of intended opening 15.

The crushing can be irregular so as to obtain an engaging arrangement provided with a lesser thickness at a zone nearer the opening promoting arrangement 39 and a larger thickness at a zone that is more distant from the opening promoting arrangement 39.

This enables a cap 1 to be obtained comprising a fracturable part provided with limited resistance to breakage in an initial step of a first opening of the cap.

In other words, irregular crushing has a similar effect to that obtained by providing fracturable elements having variable circumferal extents.

Alternatively to the crushing obtained with a suitable tool, the moulding mould can be shaped so as to mould an engaging arrangement 10 having an irregular thickness.

Figure 10:
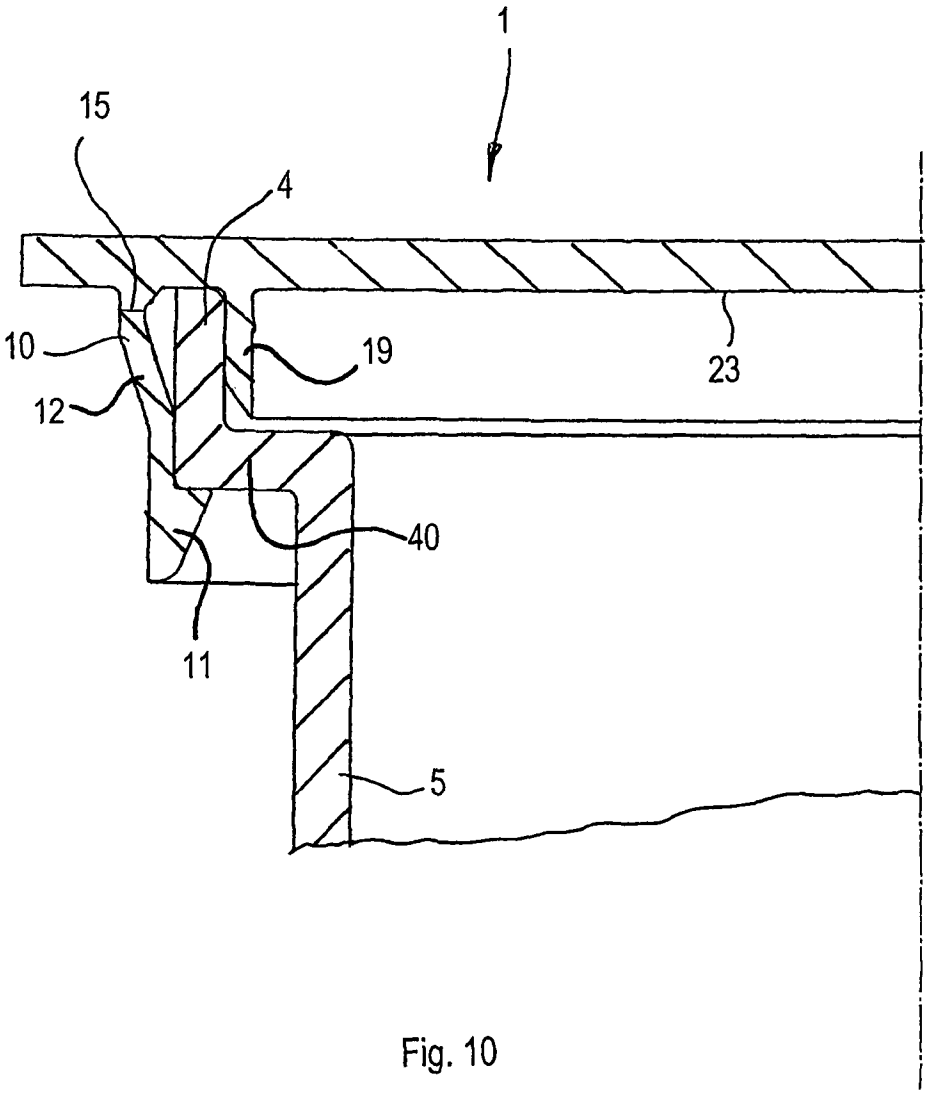
FIG. 10 is a section like the one in FIG. 7 showing a cap made according to a further variation.

With reference to FIG. 10, a cap 1 is shown provided with an engaging arrangement 10 the side body 12 of which is shaped as a frustoconical wall, the diameter of the side body 12 decreasing proceeding from the closing part 8 to the retaining arrangement 11.

With reference to FIG. 7 and FIGS. 11 to 14, the cap 1 comprises a positioning arrangement 40 arranged for substantially preventing a movement of the engaging arrangement 10 with respect to the neck 2, particularly after a first opening of the cap 1.

The positioning arrangement 40 enables the cap to be easily closed again after a first opening.

If there is no positioning arrangement 40, a movement of the side body 12 would prevent the closing part 8 associated therewith from engaging the neck 2 correctly to enable closing of the container 3.

With reference to FIG. 7, the positioning arrangement 40 comprises an arresting element 59 provided at an end of the retaining arrangement 11 and arranged for being supportingly received on a further collar 9 that protrudes from neck 2.

In this case, the collar 7 and the further collar 9 define a cavity 62 in which the hook-shaped portion of the retaining arrangement 11 is received.

As the hook-shaped portion is substantially contained inside the cavity 62, disengagement of the retaining arrangement 11 from the collar 7 by a saboteur and therefore tampering with the cap is substantially prevented.

Alternatively, if the container 3 is not provided with the further collar 9, the cavity can be delimited below by a convex part of the container 3.

Figure 27:
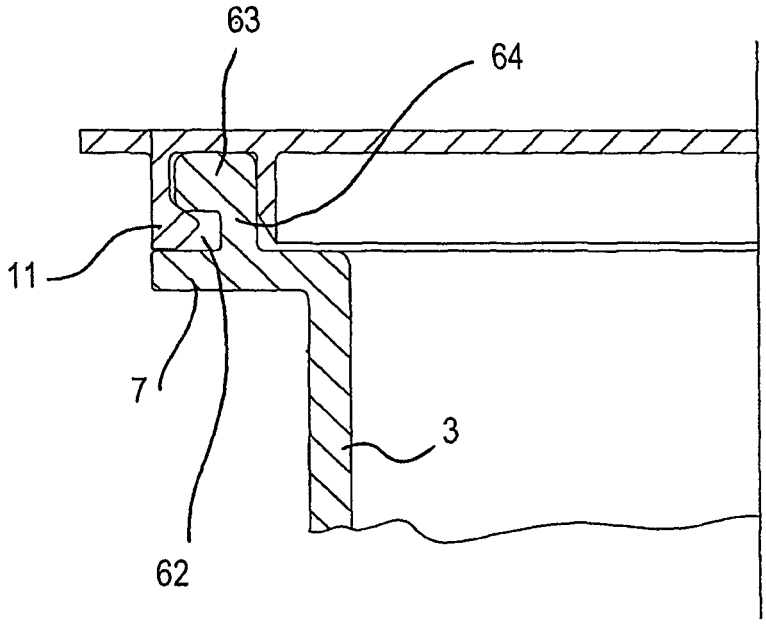
FIG. 27 is a schematic section taken along a longitudinal plane of a container made according to a further variation.

With reference to FIG. 27, a container 3 is shown in which the cavity 62 is defined by the collar 7 and by an enlargement 63 extending above the projection 7 and connected to it by a connecting wall 64 extending substantially perpendicularly to the collar 7.

With reference to FIG. 11, the positioning arrangement 40 comprises a shoulder arrangement 41 extending inside the cap 1 so as be interposed between the retaining arrangement 11 and the line of intended opening 15.

The retaining arrangement 11 and the shoulder arrangement 41 are shaped so as to surround the projection 25.

Figure 12:
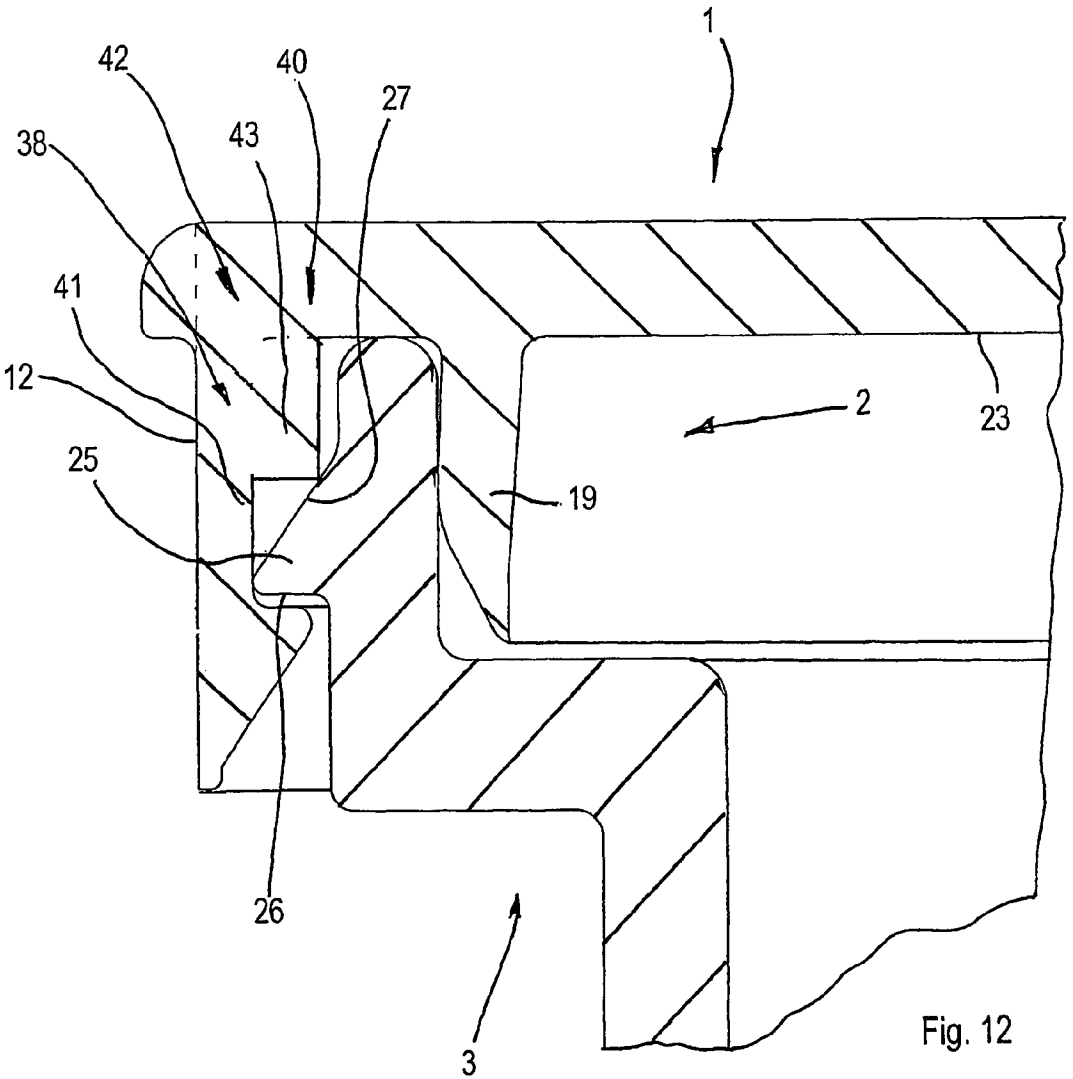
FIG. 12 is a section like the one in FIG. 11 showing a cap made according to a further variation.

With reference to FIG. 12, the positioning arrangement 40 comprises an abutting arrangement 42 arranged for interacting with the neck 2.

The abutting arrangement 42 comprises portions 43 of the ribs 38 associated with the side body 12 and supportingly received on the projection 25.

Figure 13:
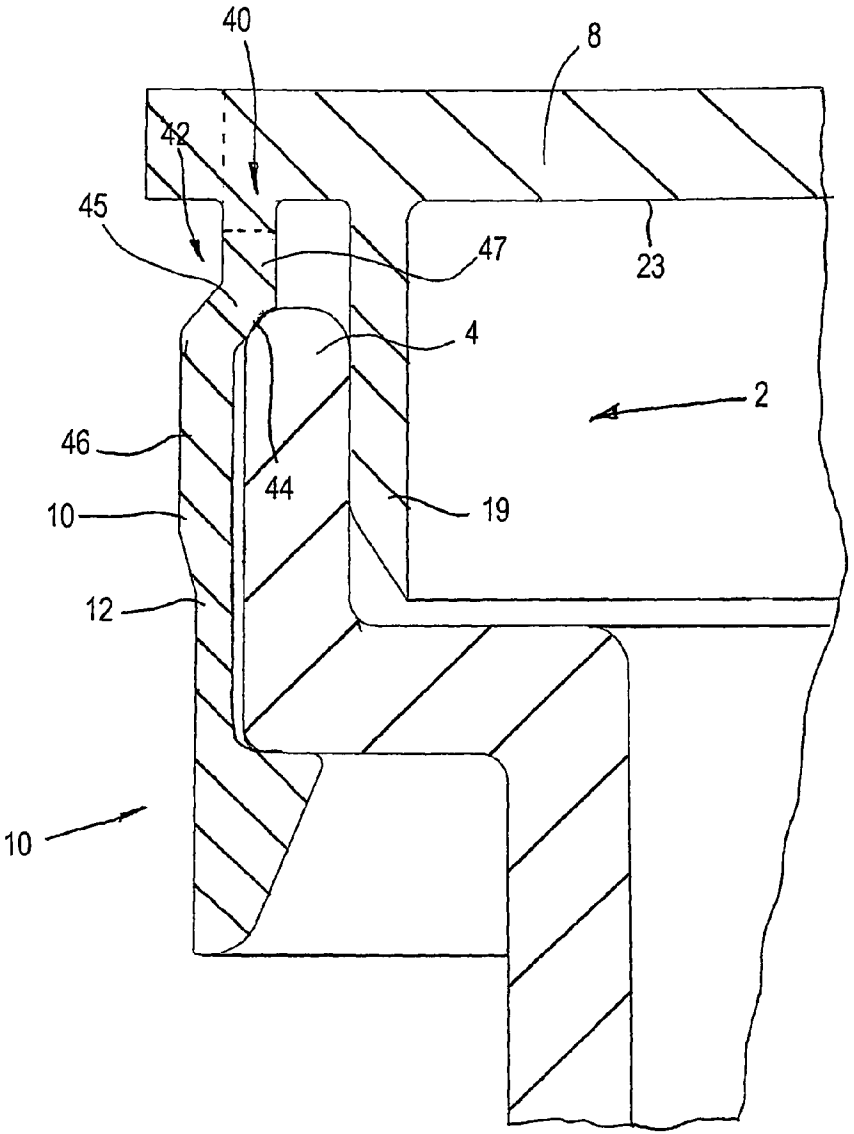
FIG. 13 is a section like the one in FIG. 7 showing a cap made according to a still further version.

With reference to FIG. 13, the abutting arrangement 42 comprises an abutting element 45, with which the engaging arrangement 10 is provided, that interacts with an end zone 44 of the neck 2.

In this case, the side body 12 comprises a first annular body 46, that surrounds the first wall 4, and a second annular body 47 having a smaller dimension than that of the first annular body 46.

The abutting element 45 comprises a portion of tilted wall that connects the first annular body 46 to the second annular body 47.

The line of intended opening 15 extends between the second annular body 47 and the closing part 8.

With reference to FIG. 14, the abutting arrangement 42 comprises a ring 48 provided at an end of the engaging arrangement 10 and arranged for interacting with an upper edge 49 of the neck 2.

The ring 48 also acts as a seal element for preventing part of the contents of the container 3 from penetrating and possibly partially remaining in a gap defined between the neck 3 and the side body 12.

Figure 20:
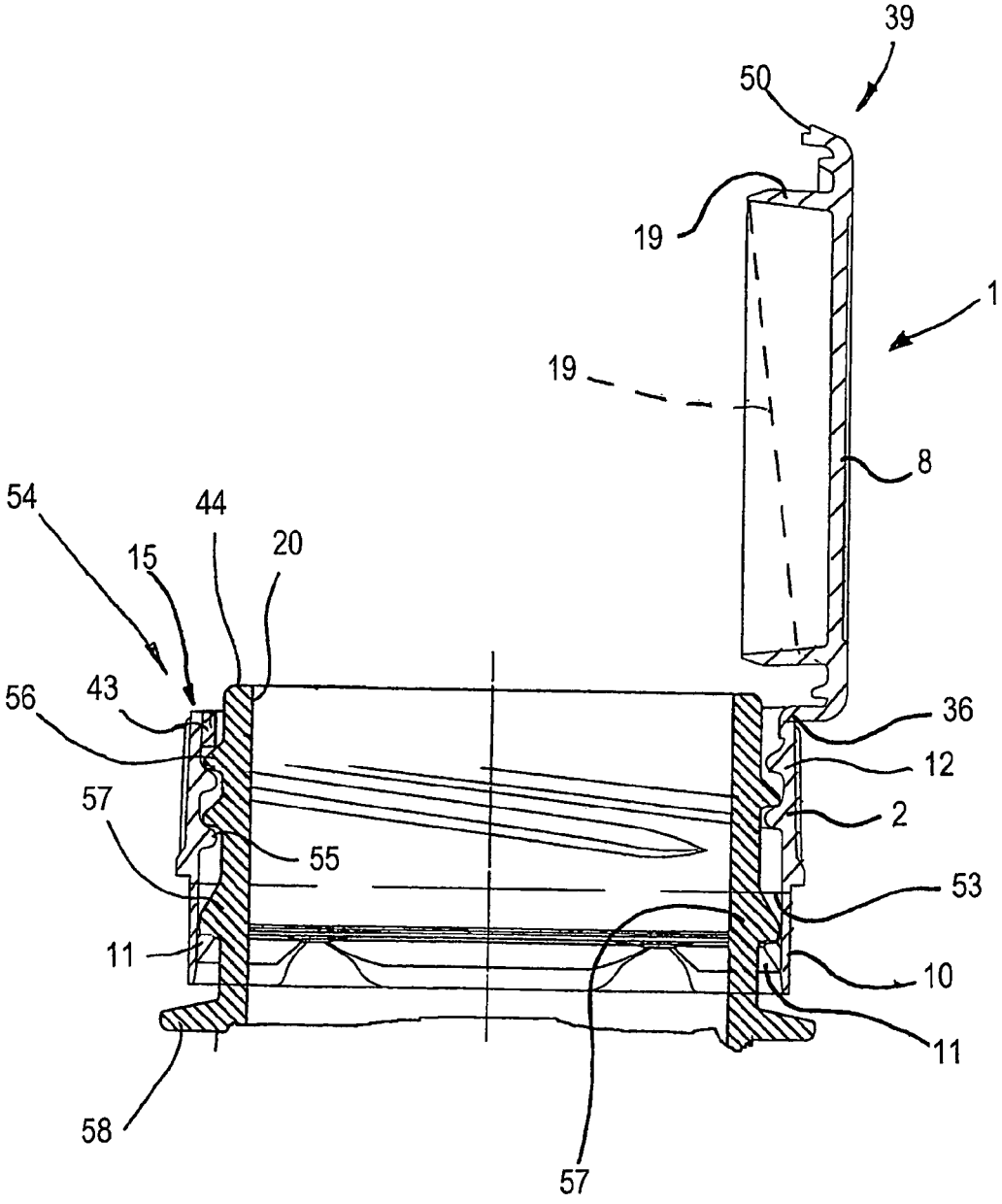
FIG. 20 is a schematic section of a cap screwed on a threaded neck of a container.

With reference to FIG. 20, a cap 1 is shown comprising an engaging arrangement 10 provided with a side body 12 provided with a thread 55 arranged for engaging a further thread 56 obtained on a neck 2 of a container 3.

The neck 2 furthermore comprises a projection arrangement 57, that cooperates with a retaining arrangement 11 with which the engaging arrangement 10 is provided, and a collar 58.

The cap 1 furthermore comprises a closing part 8, between the closing part 8 and the side body 12 a line of intended opening 15 being provided.

By acting on the closing part 8 it is possible to open the cap along the line of intended opening 15, to enable the dispensing of a product contained inside the container 3.

In this way, it is possible to obtain a pressure cap that is applicable to a usual container provided with a threaded neck.

The cap is openable with remarkable simplicity, possibly using a sole hand.

The closing part 8 can be provided with an annular appendage 19—or with a further annular appendage 21, similarly to what was disclosed with reference to FIGS. 7 and 9—arranged to engage, respectively, an internal surface 20, or a substantially smooth external surface 22, of the neck 2.

As shown in FIG. 20, between the side body 2 and the closing part 8 there can be interposed a hinge 36, that enables the cap 1 to be reclosed after a first opening.

In order to facilitate the opening of the cap 1, a promoting arrangement 39 is provided that is obtained in a zone of the closing part 8 substantially opposite a further zone in which the hinge 36 is obtained.

Figure 21:
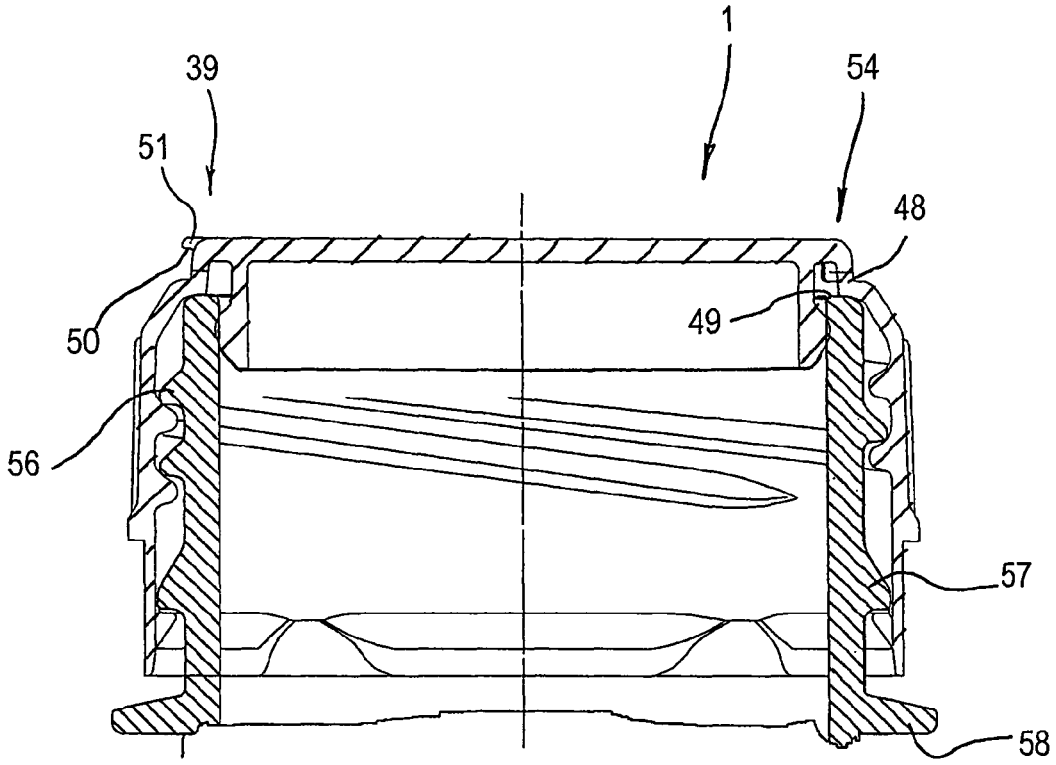
FIG. 21 is a section like the one in FIG. 20 showing a variation of the cap provided with locking arrangement for avoiding excessive screwing of the cap on the threaded neck.
Figure 23:
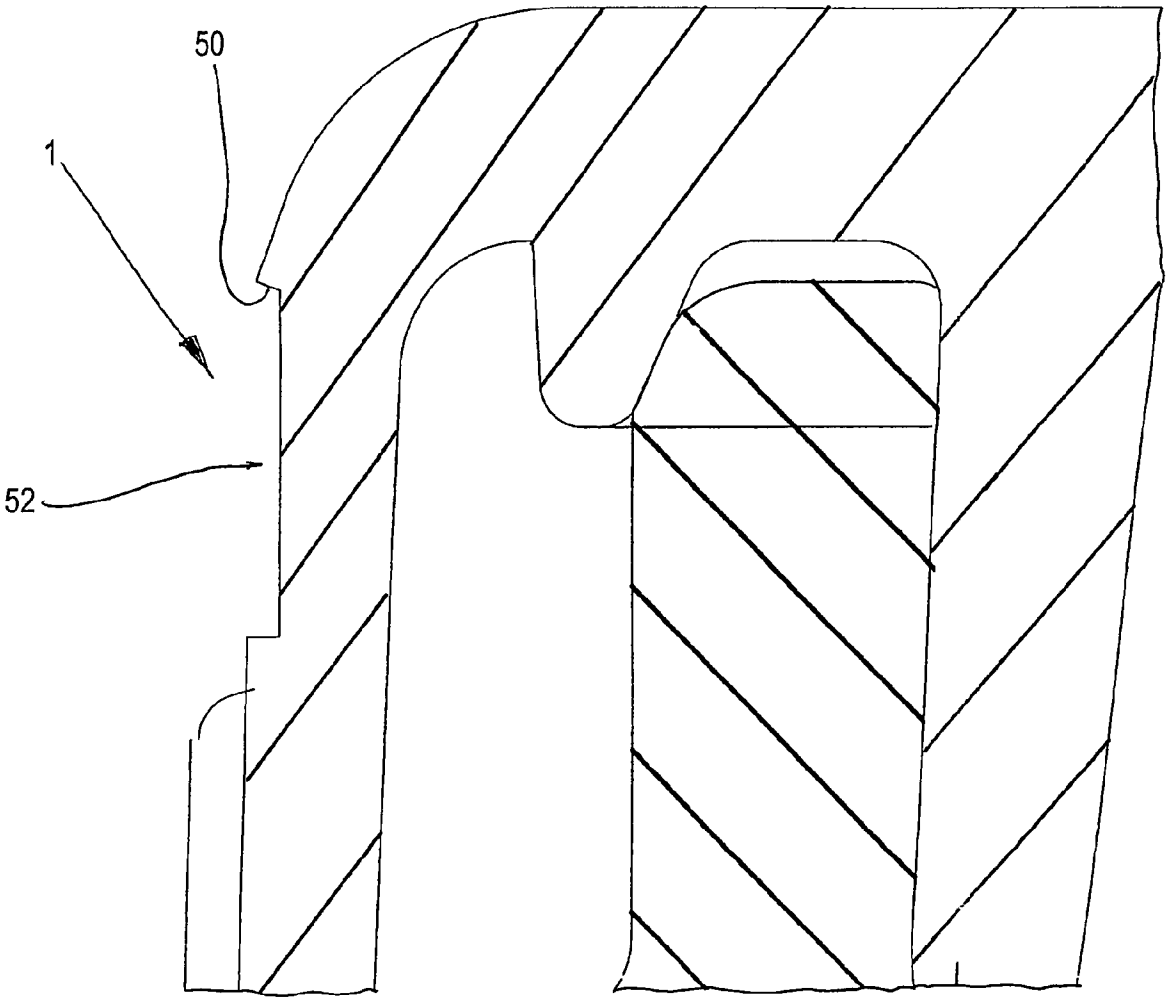
FIG. 23 is a section like the one in FIG. 20 showing an opening promoting arrangement with which the cap is provided.

The opening promoting arrangement 39 comprises an activating surface 50, on which the user exerts a force, which can be obtained, for example, in an appendage 51 projecting from the closing part 8, as shown in FIG. 21, or in a recess 52 obtained in the closing part 8, as shown in FIG. 23.

Alternatively, the activating surface 50, whether it be defined in the appendage 51, or in the recess 52, can peripherally affect the entire perimeter extent of the closing part 8.

As shown by the dashed line in FIG. 20, the annular appendage 19 can have a variable height, for example a decreasing height, by moving from the opening promoting arrangement 39 to the hinge 36, so as to promote the insertion of the annular appendage inside the wall 4.

The cap 1 furthermore comprises a further line of intended opening 53 interposed between the side body 12 and a hooking arrangement 11 with which the engaging arrangement 10 is provided.

The line of intended opening 15, the further line of intended opening 53 and the hinge 36 can be obtained with the methods disclosed with reference to FIGS. 5 to 19.

It should be noted that caps provided with the line of intended opening 15 (and possibly with the hinge 36) and caps devoid of the line of intended opening 15 can be obtained from the same semifinished product manufactured by moulding plastics.

A manufacturer of caps can choose to weaken the side wall of the aforesaid semifinished product for obtaining the line of intended opening 15, if he is interested in manufacturing caps according to the invention, or can decide not to weaken the aforementioned side wall, obtaining in this way usual caps that are applicable to threaded necks.

Thus a method of cap production is provided that is very versatile, inasmuch as it enables a change from the production of caps of a certain type to caps of a different type to be made with extreme facility.

The further line of intended opening 53 acts as an indicating element for indicating a possible opening of the container 3 achieved by unscrewing the side body 2 from the neck 3.

Figure 22:
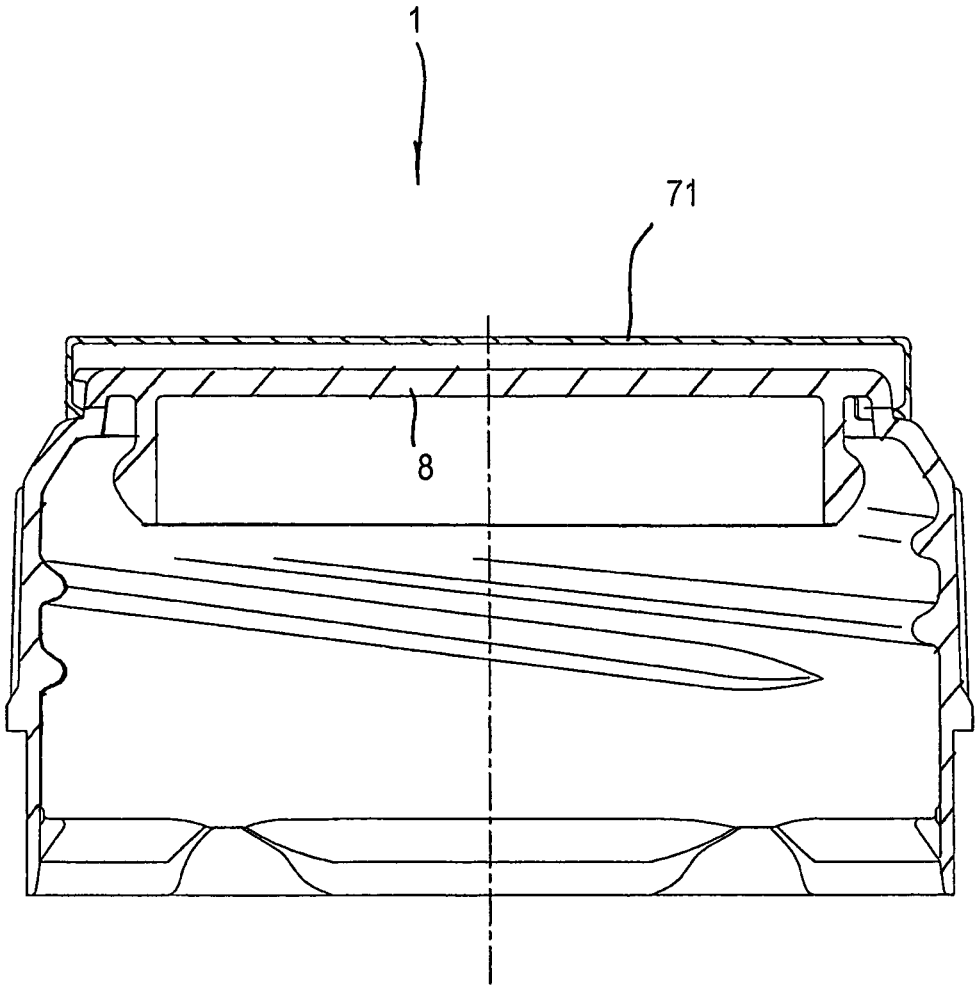
FIG. 22 is a section like the one in FIG. 20 showing a cap to which a protection cap arrangement is applied.

With reference to FIG. 22, a hood 71 is shown that is associable, for example by pressure, with the cap 1 so as to substantially cover the closing part 8. The hood 71 protects a part of the cap 1 from impurities that may come into direct contact with the mouth of a user.

The hood 71 can easily be removed before opening of the cap 1.

Also the cap embodiment specified in FIG. 14 can be equipped with a hood 71.

During bottling, a container 3, after being filled with a product, is closed with a cap 1, which is screwed onto the neck 3 by a capping head.

An opening mode of the cap according to the invention may consist of further screwing of the cap 1 onto the neck 2, which makes an edge 44 of the neck 2 interact with the closing part 8, so as to break fracturable elements 36 that define the line of intended opening 15 and to remove the closing part 8 from the neck 2.

Figure 28:
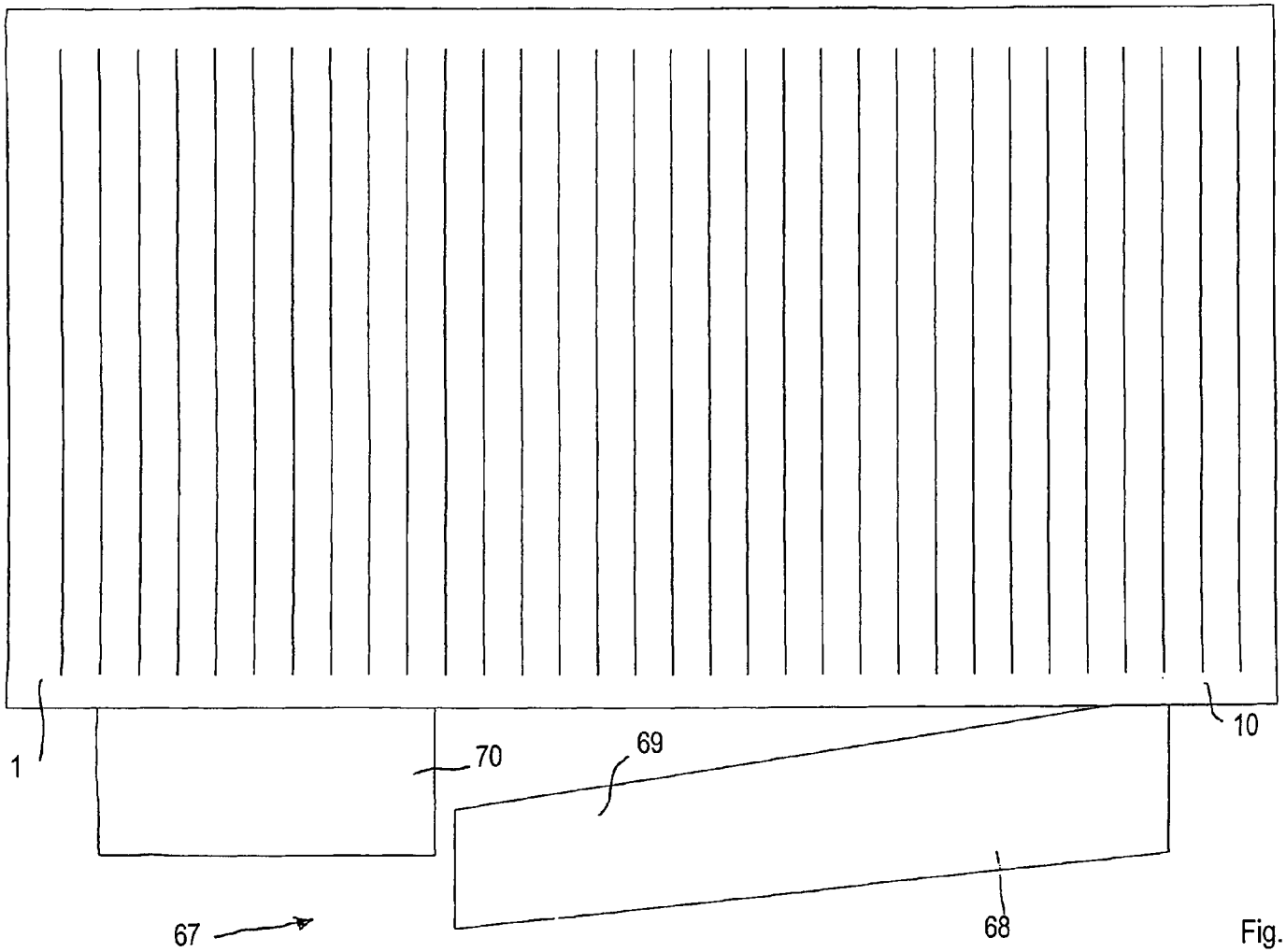
FIG. 28 is a schematic and fragmentary side view of a cap provided with an unscrewing promoting arrangement.

With reference to FIG. 28, a cap 1 is shown comprising an unscrewing promoting arrangement 67 arranged for partially unscrewing the side body 12 from the neck 2 after a first opening of the cap 1, for example carried out through the method disclosed above.

The unscrewing promoting arrangement 67 acts as a positioning arrangement that positions the side body 12 so that the closing part 8, by rotating around the hinge 36, can correctly engage the neck 2 to enable the container 3 to be closed again after a first opening.

The unscrewing promoting arrangement 67 comprises a resilient arrangement 68, for example an appendage 69 of the side body 12, shaped so as to interact with an activating arrangement 70 associated with the neck 2.

In case it is desired to prevent the opening mode disclosed above, for example to prevent undesired breakages of the fracturable elements 36 during application of the cap by the capping head, using an antiscrewing arrangement 54 is provided for.

The antiscrewing arrangement 54 also acts as a positioning arrangement that prevents a movement of the side body 12 with respect to the neck 2, to enable the cap 1 to be able to be closed again easily after a first opening.

As shown in FIG. 20, the antiscrewing arrangement 54 comprises portions 43 of ribs 38 that define the fracturable elements 36 of the line of intended opening 15.

The portions 43 are supportingly received on the further thread 56.

As shown in FIG. 21, the antiscrewing arrangement 54 comprises a ring 48 provided at an end of the side body 12 and arranged for being supportingly received on an upper edge 49 of the neck 2.

As the ring 48 is arranged abutting against the upper edge 49, the side body 12 prevents portions of a product contained in the container 3 from penetrating a gap defined between the side body 12 and the neck 2.

Figure 24:
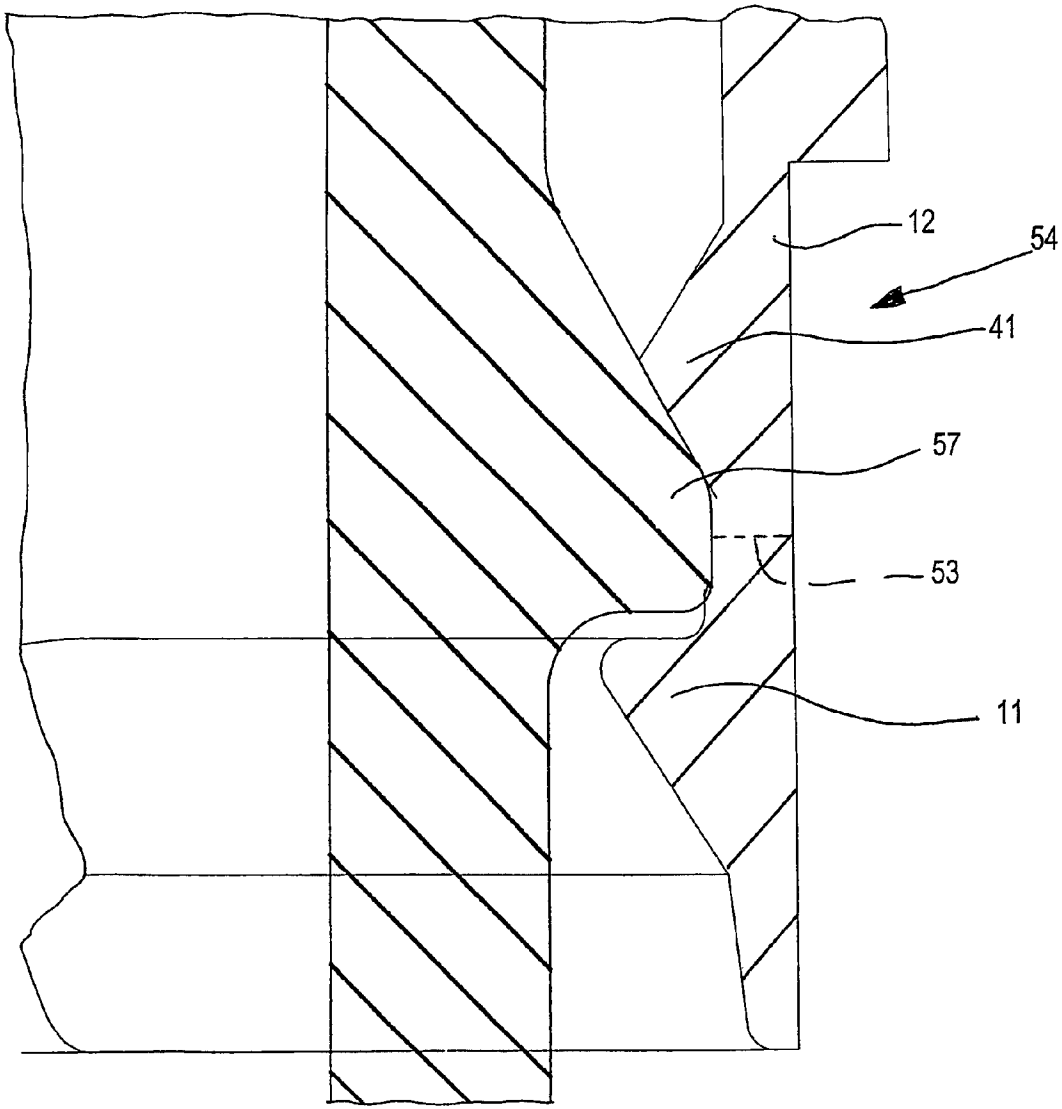
FIG. 24 is a section like the one in FIG. 20 showing a variation of the locking arrangement.

As shown in FIG. 24, the antiscrewing arrangement 54 comprises a shoulder arrangement 41 arranged for interacting with the projection arrangement 57, so that the latter is received between the shoulder arrangement 41 and the retaining arrangement 11.

Figure 25:
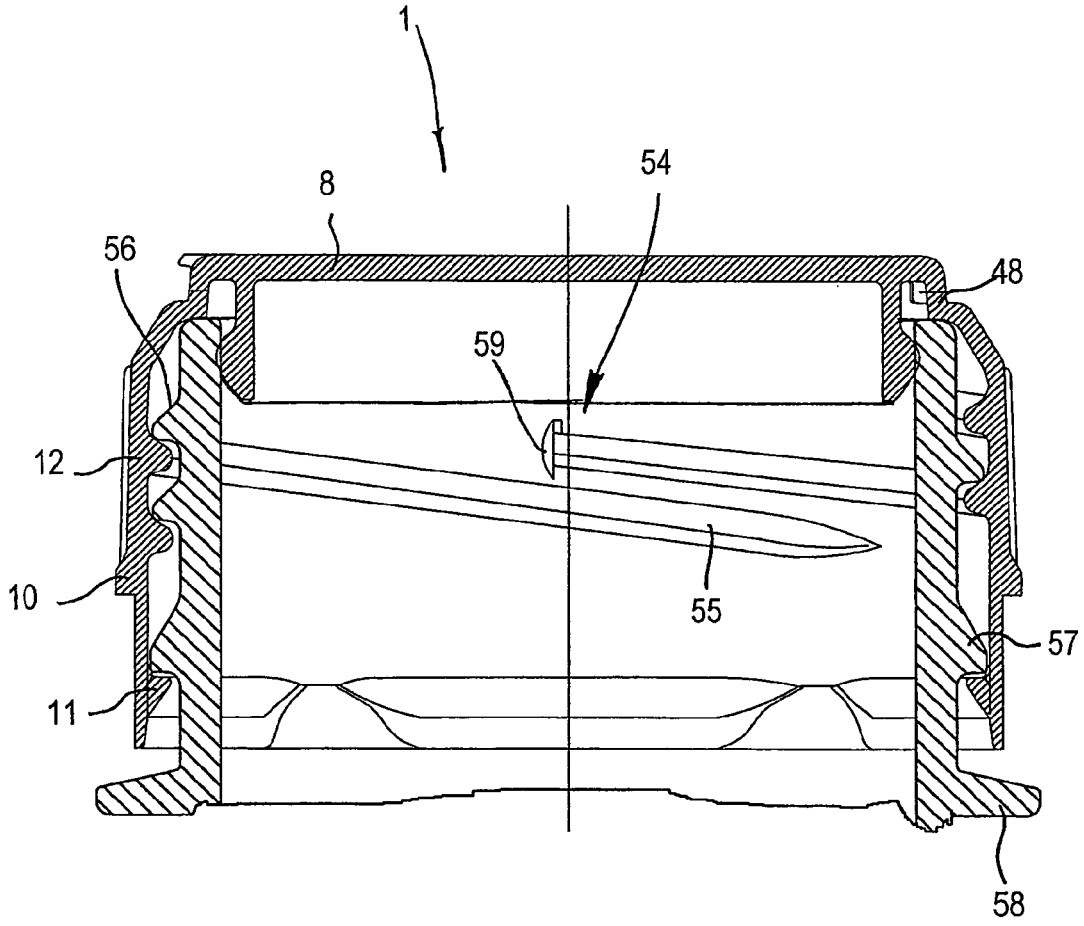
FIG. 25 is a section like the one in FIG. 20 showing another variation of the locking arrangement.

As shown in FIG. 25, the antiscrewing arrangement 54 comprises an arresting element 59 associated with the thread 55 and arranged for interacting with the further thread 56 for arresting the screwing of the side body 12 on the neck 2.

In this case, the ring 48 acts as a seal element to prevent part of the contents of the container 3 from penetrating and possibly stagnating in a gap defined between the neck 3 and the side body 12.

Figure 26:
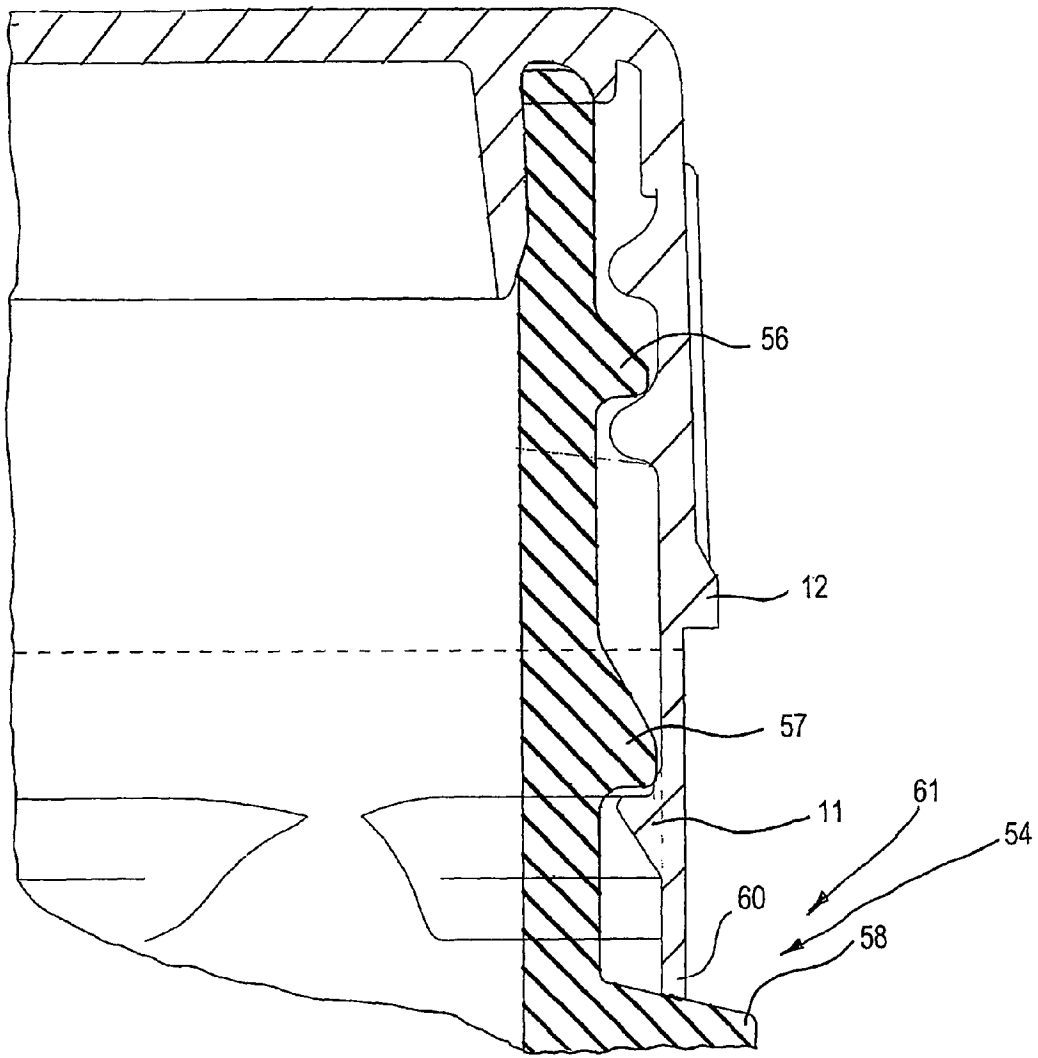
FIG. 26 is a section like the one in FIG. 20 showing a further variation of the locking arrangement.

As shown in FIG. 26, the antiscrewing arrangement 54 comprises a further arresting element 60 provided at an end 61 of the retaining arrangement 11 and arranged for being supportingly received on the collar 58.

The invention claimed is:

1. A pressure cap, comprising:

a closing part associable with an opening of a container;

an engaging arrangement associable with a neck of said container, said engaging arrangement having a side body, said engaging arrangement being provided with a retaining arrangement for engaging in a projection of said container;

a line of intended opening interposed between said side body and said closing part, said line of intended opening being defined by a fracturable arrangement having uneven resistance to fracturing, said line of intended opening and said closing part being positioned in relation to one another so that said fracturable arrangement breaks along said line of intended opening when said closing part is moved away from said side body;

an opening promoting arrangement of said closing part provided with an activating surface on which a user exerts a force so that said fracturable arrangement is fractured substantially simultaneously to the removal of said closing part from said opening, wherein said fracturable arrangement comprises a fracturable wall having a variable thickness with a lesser thickness in a first zone nearer said activating surface and a larger thickness in a remaining zone or zones that are more distant from said activating surface so as to obtain a fracturable part provided with less resistance to breakage in an initial step of a first opening of said cap.

2. The pressure cap of claim 1, wherein said closing part comprises a closing arrangement arranged for interacting with interference with an internal portion of said neck.

3. The pressure cap of claim 1, wherein said closing part comprises a further closing arrangement arranged for interacting with interference with an external portion of said neck.

4. The pressure cap of claim 3, wherein said further closing arrangement is circumferentially provided with a groove arrangement arranged for receiving in a shapingly coupled manner an appendage arrangement extending from said external portion.

5. The pressure cap of claim 1, and further comprising a hinge that connects said closing part to said side body.

6. The pressure cap of claim 5, wherein said hinge comprises a wall thickening obtained in said engaging arrangement along said line of intended opening.

7. The pressure cap of claim 1, and further comprising a positioning arrangement arranged for substantially preventing a move of said side body with respect to said neck.

8. The pressure cap of claim 7, wherein said positioning arrangement comprises an arresting element provided at an end of said retaining arrangement shaped so as to be supportingly received on a rest portion of said container.

9. The pressure cap of claim 7, wherein said positioning arrangement comprises a shoulder arrangement extending inside said cap and interposed between said retaining arrangement and said line of intended opening, said shoulder arrangement and said retaining arrangement being shaped so as to surround a further projection extending from said neck.

10. The pressure cap of claim 7, wherein said positioning arrangement comprises rib portions that define said fracturable arrangement, said portions being shaped so as to be supportingly received on a further projection extending from said neck.

11. The pressure cap of claim 7, wherein said positioning arrangement comprises an abutting element associated with said engaging arrangement and shaped so as to interact with an end zone of said neck.

12. The pressure cap of claim 7, wherein said positioning arrangement comprises a further abutting element associated with said engaging arrangement and shaped so as to be supportingly received on an edge of said neck that delimits said opening.

13. The pressure cap of claim 1, wherein the fracturable wall is made of a deformable material, and the fracturable wall includes at least first and second portions having different thicknesses.

14. A pressure cap, comprising:

a closing part a closing part associable with an opening of a container;

an engaging arrangement associable with a neck of said container, said engaging arrangement having a side body, said engaging arrangement being provided with a retaining arrangement for engaging in a projection of said container;

a line of intended opening interposed between said side body and said closing part, said line of intended opening being defined by a fracturable arrangement having uneven resistance to fracturing, said line of intended opening and said closing part being positioned in relation to one another so that said fracturable arrangement breaks along said line of intended opening when said closing part is moved away from said side body;

an opening promoting arrangement of said closing part provided with an activating surface on which a user exerts a force so that said fracturable arrangement is fractured substantially simultaneously to the removal of said closing part from said opening, wherein said fracturable arrangement comprises a plurality of fracturable elements having circumferentially different extents with a lesser circumferential extent in a first zone nearer said activating surface and a larger circumferental extent in a remaining zone or zones that are more distant from said activating surface so as to obtain a fracturable part provided with less resistance to breakage in an initial step of a first opening of said cap.

15. A pressure cap, comprising:

a closing part associable with an opening of a container;

an engaging arrangement associable with a neck of said container, said engaging arrangement having a side body, said engaging arrangement being provided with a retaining arrangement for engaging in a projection of said container;

a line of intended opening interposed between said side body and said closing part, said line of intended opening being defined by a fracturable arrangement having uneven resistance to fracturing, said line of intended opening and said closing part being positioned in relation to one another so that said fracturable arrangement breaks along said line of intended opening when said closing part is moved away from said side body;

an opening promoting arrangement of said closing part provided with an activating surface on which a user exerts a force so that said fracturable arrangement is fractured substantially simultaneously to the removal of said closing part from said opening, wherein said fracturable arrangement has a growing fracturable section moving away in a circumferential direction from a gripping zone of said closing part that can be grasped by a user for opening said cap so as to obtain a fracturable part provided with less resistance to breakage in an initial step of a first opening of said cap.

16. A cap, comprising:

a side body associable with a neck of a container;

a closing part associable with an opening of said container; and a line of intended opening defined by a fracturable arrangement and interposed between said side body and said closing part, wherein said fracturable arrangement has non-uniform breaking resistance, said fracturable arrangement comprising a fracturable wall having a variable thickness with a lesser thickness in a first zone nearer a gripping zone of said closing part that can be grasped by a user for opening said cap and a larger thickness in a remaining zone or zones that are more distant from said gripping zone so as to obtain a fracturable part provided with less resistance to breakage in an initial step of a first opening of said cap.

17. The cap of claim 16, wherein said fracturable arrangement has a growing section moving away from said gripping zone.

18. The cap of claim 16, comprising a wall thickening in said line of intended opening so as to form a hinge that connects said side body and said closing part.

19. The cap of claim 16, wherein the fracturable wall includes at least first and second portions having different thicknesses, and the first and second portions are made of a same material.

20. A cap, comprising:

a side body associable with a neck of a container;

a closing part associable with an opening of said container; and a line of intended opening defined by a fracturable arrangement and interposed between said side body and said closing part, wherein said fracturable arrangement has non-uniform breaking resistance, wherein said fracturable arrangement comprises a plurality of fracturable elements having circumferentially different extents with lesser extent in a first zone nearer a gripping zone of said closing part that can be grasped by a user for opening said cap and a larger extent in a remaining zone or zones that are more distant from said gripping zone so as to obtain a fracturable part provided with less resistance to breakage in an initial step of a first opening of said cap.

21. The cap of claim 20, wherein said fracturable arrangement has a growing section moving away from said gripping zone.

22. A cap, comprising:

a side body associable with a neck of a container;

a closing part associable with an opening of said container; and a line of intended opening defined by a fracturable arrangement and interposed between said side body and said closing part, wherein said fracturable arrangement has non-uniform breaking resistance, wherein said fracturable arrangement has a growing fracturable section moving away in a circumferential direction from a gripping zone of said closing part that can be grasped by a user for opening said cap so as to obtain a fracturable part provided with less resistance to breakage in an initial step of a first opening of said cap.

* * * * *

UNITED STATES PATENT AND TRADEMARK OFFICE

CERTIFICATE OF CORRECTION

PATENT NO. : 8,424,697 B2
APPLICATION NO. : 11/919335
DATED : April 23, 2013
INVENTOR(S) : Pucci It is certified that error appears in the above-identified patent and that said Letters Patent is hereby corrected as shown below:

On the Title Page Item (73) Assignee, please correct "Sacmi Cooper MacCanici Imola Societa' Cooperativa" to --SACMI Cooperativa Meccanici Imola Società Cooperativa--.

Signed and Sealed this
Twenty-third Day of December, 2014

Michelle K. Lee

Michelle K. Lee
*Deputy Director of the United States Patent and Trademark Office*